US011677179B2

(12) United States Patent
Gross

(10) Patent No.: US 11,677,179 B2
(45) Date of Patent: Jun. 13, 2023

(54) SEALED FFC ELECTRICAL CONNECTORS

(71) Applicant: FCI USA LLC, Etters, PA (US)

(72) Inventor: Charles M. Gross, Dillsburg, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 17/529,468

(22) Filed: Nov. 18, 2021

(65) Prior Publication Data

US 2022/0158385 A1 May 19, 2022

Related U.S. Application Data

(60) Provisional application No. 63/116,124, filed on Nov. 19, 2020.

(51) Int. Cl.

| | |
|---|---|
| ***H01R 13/52*** | (2006.01) |
| ***H01R 12/88*** | (2011.01) |
| ***H01R 12/79*** | (2011.01) |
| ***H01R 13/627*** | (2006.01) |

(52) U.S. Cl.

CPC ..... *H01R 13/5219* (2013.01); *H01R 12/79* (2013.01); *H01R 12/88* (2013.01); *H01R 13/6272* (2013.01)

(58) Field of Classification Search

CPC .. H01R 23/684; H01R 13/5219; H01R 12/88; H01R 12/79; H01R 13/6272

USPC ..... 439/260, 271

See application file for complete search history.

(56) References Cited

U.S. PATENT DOCUMENTS

| | | | | |
|---|---|---|---|---|
| 3,864,012 | A * | 2/1975 | Cutchaw | H01R 12/79 439/493 |
| 5,083,933 | A * | 1/1992 | Colleran | H01R 13/6272 439/271 |
| 7,214,081 | B1 * | 5/2007 | Ju | H01R 12/88 439/495 |
| 8,128,425 | B2 * | 3/2012 | Takahashi | H01R 12/79 439/260 |
| 8,221,147 | B2 * | 7/2012 | Ozeki | H01R 12/88 439/260 |
| 8,636,531 | B2 * | 1/2014 | Sasaki | H01R 12/79 439/260 |
| 8,662,915 | B2 * | 3/2014 | Ueda | H01R 12/88 439/495 |
| 10,559,914 | B2 | 2/2020 | Goossens et al. | |
| 11,189,971 | B2 | 11/2021 | Lu | |
| 2002/0081884 | A1 * | 6/2002 | Asai | H01R 12/00 439/260 |

(Continued)

*Primary Examiner* — Gary F Paumen

(74) *Attorney, Agent, or Firm* — Wolf, Greenfield & Sacks, P.C.

(57) ABSTRACT

A sealable FFC connector includes a housing, a plurality of contacts, a sealing member, and an actuator. The housing includes a slot configured to receive a mating component. The contacts are held in the housing and are configured to be in electrical contact with the mating component when the mating component is in a mated position in the slot. The sealing member includes at least a portion supported by the housing. The actuator is coupled to the housing and is movable from an opened position, in which the mating component may be inserted in the slot, to a closed position, in which a biasing force is applied on the sealing member such that, when the mating component is in the mated position in the slot, the sealing member provides a seal to prevent moisture and debris from entering the slot.

20 Claims, 17 Drawing Sheets

(56) References Cited

U.S. PATENT DOCUMENTS

| | | | | |
|---|---|---|---|---|
| 2004/0266242 | A1* | 12/2004 | Shiu | H01R 12/88 439/260 |
| 2010/0304591 | A1* | 12/2010 | Ishishita | H01R 12/88 439/260 |
| 2013/0023139 | A1* | 1/2013 | Lyda | H01R 13/5213 439/272 |
| 2015/0180149 | A1* | 6/2015 | Nakamura | H01R 12/721 439/267 |
| 2016/0164207 | A1* | 6/2016 | Nakamura | H01R 12/7082 439/267 |
| 2017/0373432 | A1* | 12/2017 | Chen | H01R 13/6275 |
| 2019/0032906 | A1* | 1/2019 | Webb | F21S 43/14 |

* cited by examiner

SEALED FFC ELECTRICAL CONNECTORS

CROSS-REFERENCE TO RELATED APPLICATIONS

The present application claims the benefit of priority of U.S. Provisional Application No. 63/116,124 filed Nov. 19, 2020, entitled "SEALED FFC ELECTRICAL CONNECTORS", the entire contents of which is incorporated by reference herein.

FIELD OF THE INVENTION

This disclosure relates generally to electrical interconnection systems and more specifically to FFC electrical connectors that provide sealed connections that prevent moisture and/or debris from reaching electrical contacts.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange power, data, commands, and/or other signals with one or more other electronic devices. Electrical connectors are basic components needed to make some electrical systems functional. Signal transmission to transfer information (e.g., data, commands, and/or other electrical signals) often utilize electrical connectors between electronic devices, between components of an electronic device, and between electrical systems that may include multiple electronic devices.

It is generally easier and more cost effective to manufacture an electrical system as separate electronic assemblies, such as printed circuit boards ("PCBs"), which may be communicatively joined together with electrical connectors. In some scenarios, the PCBs to be joined may each have connectors mounted on them. The connectors may be mated together directly to interconnect the PCBs.

In other scenarios, the PCBs may be connected indirectly via a cable. Electrical connectors may nonetheless be used to make such connections. For example, the cable may be terminated on one or both ends with a plug type of electrical connector ("plug connector"). A PCB may be equipped with a receptacle type of electrical connector ("receptacle connector") into which the plug connector may be inserted to connect the cable to the PCB. A similar arrangement may be used at the other end of the cable, to connect the cable to another PCB, so that signals and/or power may pass between the PCBs via the cable.

In some cases, a flexible flat cable (FFC), sometimes called a flexible printed circuit (FPC), may be used to route signals between components on different PCBs or on the same PCB. To support such connections, FFC connectors may be used to connect FFCs to PCBs. A FFC connector may be configured as a receptacle connector ("FFC receptacle connector"). Rather than receive a plug connector attached to the FFC, the FFC receptacle connector may have electrical contacts that mate to conductive pads attached to electrical traces of the FFC, such that an end or connection portion of the FFC might be inserted into the FFC receptacle connector.

In some cases, the FFC receptacle connector may include a locking mechanism to lock the FFC in the connector, which may prevent the FFC from unintentional disconnection from the connector, and which may ensure a stable electrical connection between the FFC and the PCB on which the connector is mounted. For example, a locking mechanism may be manipulated by a user to place the FFC in a locked position (e.g., when an electrical connection between the FFC and the PCB is desired), and to release the FFC from the locked position (e.g., when the FFC is to be disconnected from the PCB).

SUMMARY

According to an aspect of the present technology, an electrical connector is provided. The connector may include: a housing having a slot configured to receive a mating component; a plurality of contacts held in the housing and configured to be in electrical contact with the mating component when the mating component is in a mated position in the slot; a resilient member having at least a portion supported by the housing; an actuator pivotably coupled to the housing and configured to have: an opened position in which the mating component may be inserted in the slot, and a closed position in which a biasing force is applied on the resilient member such that, when the mating component is in the mated position in the slot, the resilient member provides a moisture-resistant seal around a surface of the mating component.

In some embodiments of this aspect, the actuator may include at least one latching protrusion configured to latch with the housing when the actuator is in the closed position. Each latching protrusion may be configured to produce an audible sound when the actuator is pivoted to the closed position.

In some embodiments of this aspect, the resilient member may include a lower seal portion and an upper seal portion, the housing may include a ledge with a lower seal groove configured to receive the lower seal portion, and the actuator may include a longitudinal arm with an upper seal groove configured to receive the upper seal portion. When the actuator is in the opened position, the lower seal portion may not directly contact the upper seal portion.

In some embodiments of this aspect, the housing may include a rear housing portion and a front housing portion that is detachable from the rear housing portion. The contacts may be held in the rear housing portion. The front housing portion may include a lower front portion and an upper front portion that is detachable from the lower front portion. The lower front portion may include a lower seal groove configured to receive a lower portion of the resilient member. The upper front portion may include an upper seal groove configured to receive an upper portion of the resilient member.

According to an aspect of the present technology, a sealable electrical connector is provided. The connector may include: a housing having a slot configured to receive a mating component; a plurality of contacts held in the housing and configured to be in electrical contact with the mating component when the mating component is in a mated position in the slot; a sealing member having at least a portion supported by the housing; and an actuator coupled to the housing and movable from an opened position, in which the mating component may be inserted in the slot, to a closed position, in which a biasing force is applied on the sealing member such that, when the mating component is in the mated position in the slot, the sealing member provides a seal to prevent moisture and debris from entering the slot.

In some embodiments of this aspect, the sealing member may include a lower seal portion and an upper seal portion, the housing may include a lower seal groove configured to receive the lower seal portion, and a longitudinal arm of the actuator may include an upper seal groove configured to receive the upper seal portion. When the actuator is in the opened position, the lower seal portion may not directly contact the upper seal portion.

In some embodiments of this aspect, the housing may include a rear housing portion and a front housing portion that is detachable from the rear housing portion. The contacts may be held in the rear housing portion. The front housing portion may include a lower front portion and an upper front portion that is detachable from the lower front portion. The lower front portion may include a lower seal groove configured to receive a lower portion of the sealing member. The upper front portion may include an upper seal groove configured to receive an upper portion of the sealing member.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

DETAILED DESCRIPTION

The inventor has recognized and appreciated designs and techniques that enable a connector to be simply constructed while providing robust performance over its lifetime, and that enable the connector to be used reliably even when deployed in an outdoor environment. These designs and techniques may be applied to a receptacle connector that includes an actuator with one or more latches configured to engage with a housing of the connector. The actuator may have an opened position, in which a connection portion of a FFC may be inserted to a mated position in a slot of the housing or may be removed from the mated position and withdrawn from the slot. The actuator may be moved by a user to a closed position at which the latch(es) engage with one or more latch-receiving recess(es) of the housing. In some embodiments of the present technology disclosed herein, the user may hear an audible sound (e.g., a click) when the latch(es) become fully and properly engaged with the recess(es). Thus, the user may have not only a visible confirmation that a proper connection was made (e.g., via a relative position of the actuator and the housing), but may also have an audible confirmation as well. The actuator also may include one or more blocker(s) configured to block or prevent the connection portion of the FFC from moving out of the mated position when the actuator is in the closed position. For example, the blocker(s) may have a surface that faces a surface of the connection portion of the FFC when the FFC is in the mated position and the actuator is in the closed position, to block the FFC from being unintentionally pulled out of the slot.

In order to prevent the outdoor environment in which the connector is deployed from adversely affecting an electrical connection between the FFC and the connector's electrical contacts located in the housing, a resilient sealing member may be used to surround part of the connection portion of the FFC, to prevent moisture and/or debris from entering the slot of the housing when the FFC is in the mated position and the actuator is in the closed position. In some embodiments of the present technology, when the latch(es) of the actuator engage with the recess(es) of the housing, a biasing force may be applied to the sealing member such that the sealing member may be urged against the connection portion of the FFC to form a seal that prevents moisture and/or debris from entering the slot.

In addition to being suitable for use outdoors (e.g., in rainy, windy, and/or dusty environments), the sealed connectors described herein may be compact in size, enabling them to be used in miniaturized electronics. For example, the sealed connectors may be deployed in any of: an automobile, a motorized scooter, a drone, etc., as well as in electronically equipped "smart" apparel.

Figure 1:
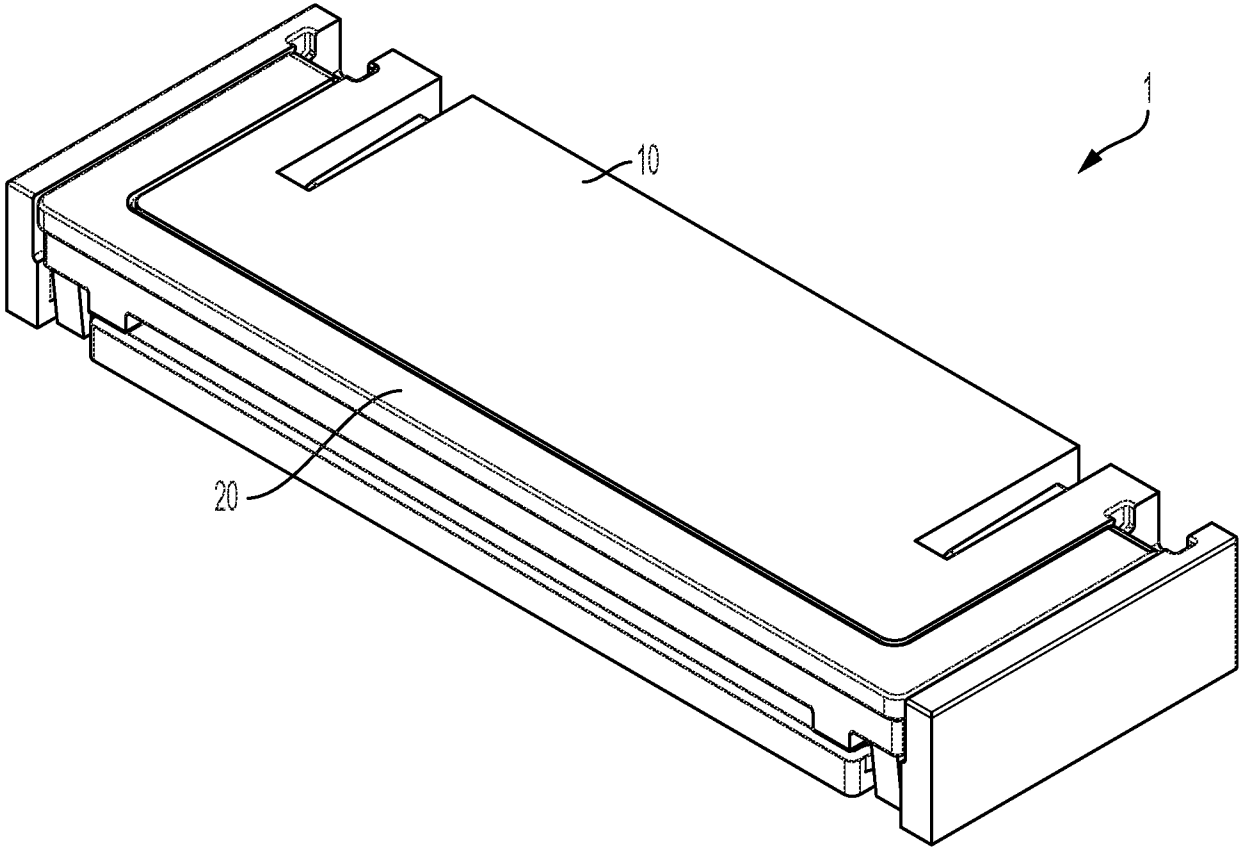
FIG. 1 is a front top perspective view of an electrical connector, according to some embodiments of the present technology.

FIG. 1 shows a front top perspective view of a sealable electrical connector 1, according to some embodiments of the present technology. The connector 1 may include a housing 10 and an actuator 20. The actuator 20 is in a closed position in FIG. 1, such that an outer surface of the actuator 20 is flush with a surface of the housing 10. As depicted in FIG. 1, the connector 1 may have a generally orthorhombic shape when the actuator 20 is in the closed position, enabling a user to have visual confirmation that the actuator is fully closed.

Figure 2:
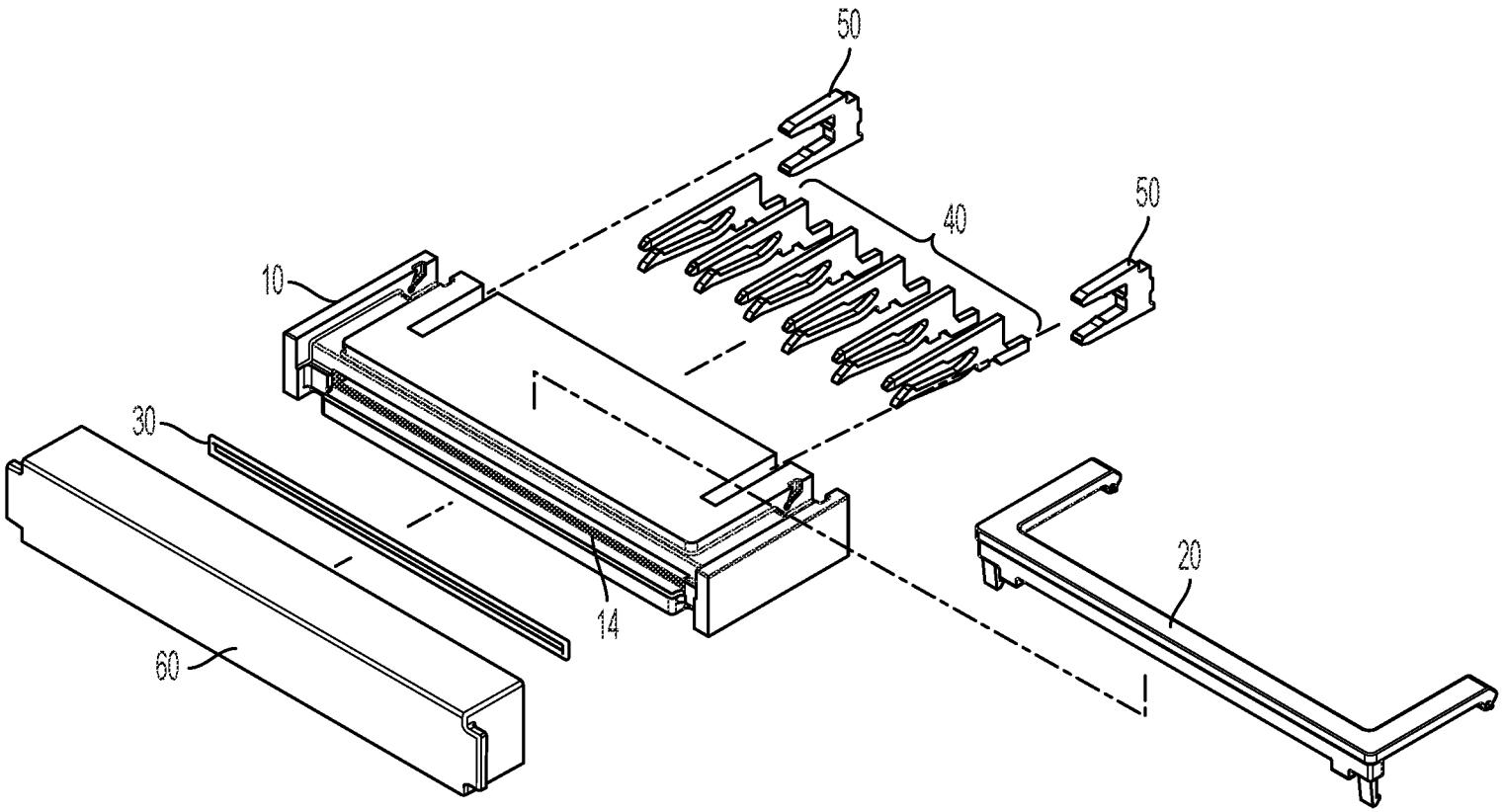
FIG. 2 is a front top perspective view of the electrical connector of FIG. 1 in a disassembled state.

FIG. 2 shows a front top perspective view of the connector 1 in a disassembled state. In addition to the housing 10 and the actuator 20, the connector 1 may include a resilient member 30 configured to provide a seal around a mating member when the mating member is mated with the connector 1, as described below in connection with FIGS. 6A-6D. The resilient member 30 may be formed of a polymeric elastomer that may deform under pressure. That is, under pressure, one or more surface portion(s) of the resilient member 30 may conform to a surface contour of one or more adjacent surface(s). Thus, a seal may form between the surface portion(s) of the resilient member 30 and the adjacent surface(s) when pressure is applied to the resilient member 30.

In some embodiments of the present technology, the resilient member 30 may be formed of a synthetic rubber, a natural rubber, or a combination of synthetic and natural rubbers. In some implementations, the resilient member 30 may, at least one part, be formed of an ethylene propylene diene monomer (EPDM) rubber or a nitrile butadiene (NBR) rubber or a combination of these rubbers. In some implementations, the resilient member 30 may, at least in part, be formed of an "O-ring" of fluoropolymer rubber (e.g., Viton™, produced by the Chemours Co., Wilmington, Del., USA), which need not be circular in shape but instead may have a rectangular shape or any other shape. A cross-sectional thickness of the resilient member 30 may be about 0.20 mm or less, or about 0.19 mm or less, or about 0.185 mm or less. As described below, the resilient member 30 may be structured to be a continuous loop or may have separate sections that form a loop when an applied force urges the sections against each other.

As will be appreciated, the resilient member 30 may be formed of any resilient material able to provide a sufficient seal or barrier against environmental conditions that may be encountered where the connector 1 is deployed. In some embodiments of the present technology, the resilient member 30 may enable the connector 1 to have an ingress protection (IP) rating of IP5K4 under DIN 40050 standards, thus enabling the connector 1 to be suitable for use in, e.g., automobiles.

Returning to FIG. 2, the housing 10 may include a seal groove 14 configured to accommodate the resilient member 30. In some embodiments of the present technology, when the resilient member 30 is seated in the seal groove 14, the actuator 20 may be moved relative to the housing 10 to cause a sealing force to be applied to the resilient member 30, as described below.

A plurality of electrical contacts 40 may be accommodated in an interior of the housing 10. The contacts 40 may be arranged in the housing 10 to engage with the mating member when the mating member is mated with the connector 1, such that the contacts 40 are in electrical contact with the mating member. In some embodiments of the present technology, each of the contacts 40 may electrically contact a corresponding contact pad on a surface of the mating member when the mating member is mated with the connector 1.

One or more retainer clip(s) 50 may be used to provide a clamping force to the housing 10. For example, a pair of retainer clips 50 may be used to provide a clamping force to a rear side of the housing 10, opposite to a mating side of the housing 10. The housing 10 may include one or more retainer clip recess(es) 16 (see FIGS. 14A and 14B) onto which the retainer clip(s) 50 may latch.

Optionally, a removable cover 60 may be provided to cover the mating side of the housing 10. The cover 60 may be used advantageously to prevent dust and/or debris from entering a slot on the mating side of the housing 10, or to prevent a worker's tool from inadvertently damaging structures on the mating side of the housing 10. The cover 60 may be removed when the connector 1 is to be coupled to the mating member.

Figure 3:
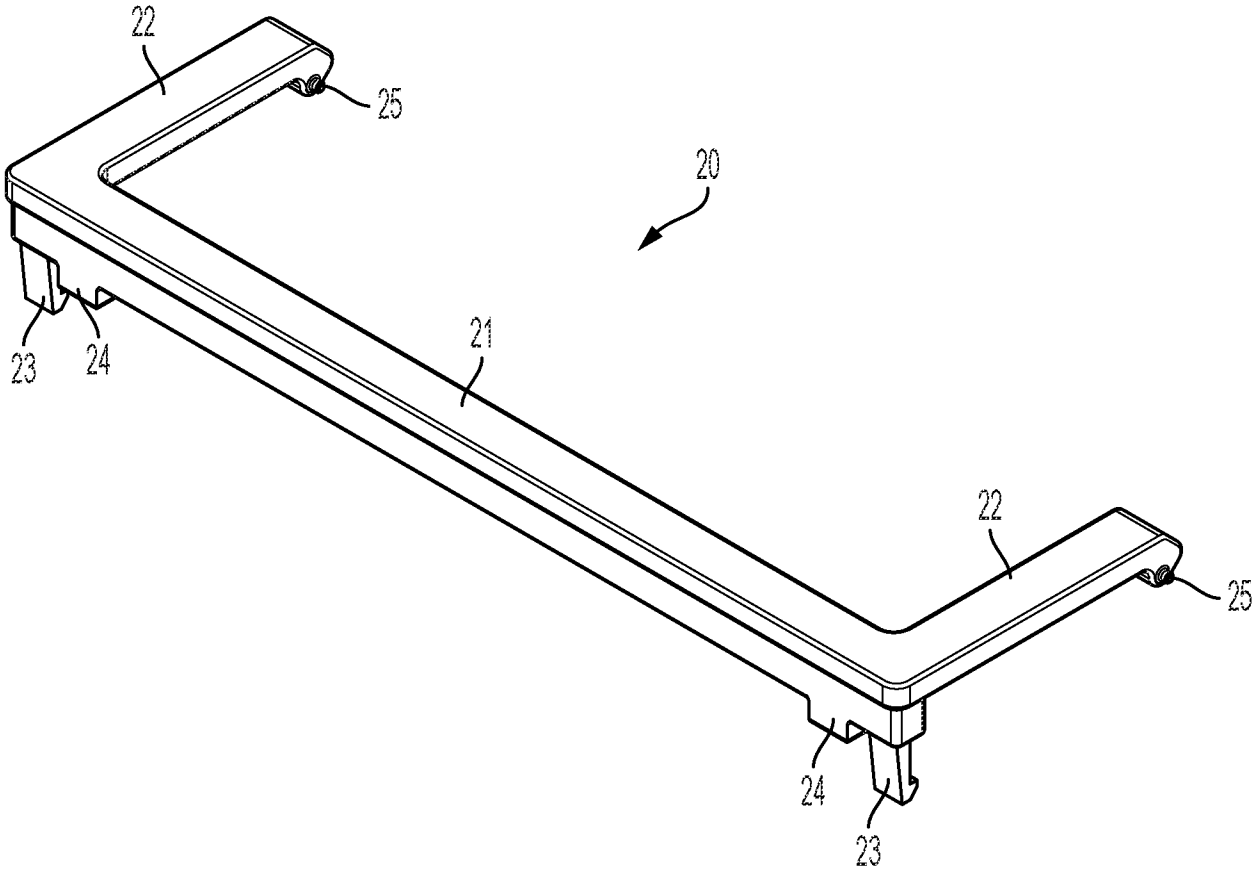
FIG. 3 is a front top perspective view of an actuator of the electrical connector of FIG. 1, according to some embodiments of the present technology.

FIG. 3 shows a front top perspective view of the actuator 20, according to some embodiments of the present technology. The actuator 20 may include a longitudinal main arm 21 and a side arm 22 extending from each end of the main arm 21. For example, the side arms 22 may extend orthogonally from the ends of the main arm 21. As will be appreciated, however, the side arms 22 may extend at one or more non-orthogonal angle(s) relative to the main arm 21. At least one pivot protrusion 25 may be located at a free end of each of the side arms 22. The pivot protrusions 25 may be structured to engage with and rotate in corresponding recesses in the housing 10 to enable the actuator 20 to move (i.e., pivot) relative to the housing 10. For example, the pivot protrusions 25 may enable the actuator to pivot from an opened position (see, e.g., FIG. 4A) to the closed position shown in FIG. 1.

In some embodiments of the present technology, the side arms 22 may each have a pair of pivot protrusions 25 located at, e.g., inner and outer sides of each of the side arms 22. Such an arrangement of the pivot protrusions 25 may be used to engage with corresponding recesses in trench sidewalls of the housing 10, as discussed below.

One or both end(s) of the main arm 21 may include a latching protrusion 23 configured to engage with the housing 10 when the actuator 20 is in the closed position, to put the connector 1 in a locked state. For example, if the mating member is in the mated position in the housing 10 when the connector 1 is in the locked state, the mating member may be prevented from being removed from connector 1 by the locked latching protrusion(s) 23. In some embodiments of the present technology, the actuator 20 may include two latching protrusions 23 that extend orthogonally from the ends of the main arm 21, in a direction different from a direction of the side arms 22, as shown in FIG. 3. It should be understood that the latching protrusion(s) 23 need not be located at the ends of the main arm 21 but instead may be located at other positions on the actuator 20, as long as they are configured to engage with the housing 10 to lock the connector 1 when in the closed position.

The actuator 20 may include one or more blocking protrusion(s) 24 configured to block movement of a connection portion of the mating member when the mating member is in the mated position in the housing 10. When the actuator 20 is in the closed position, each blocking protrusion 24 may face and/or contact part of the connection portion of the mating member, thus preventing the connection portion of the mating member from shifting relative to the housing 10.

Figure 4B:
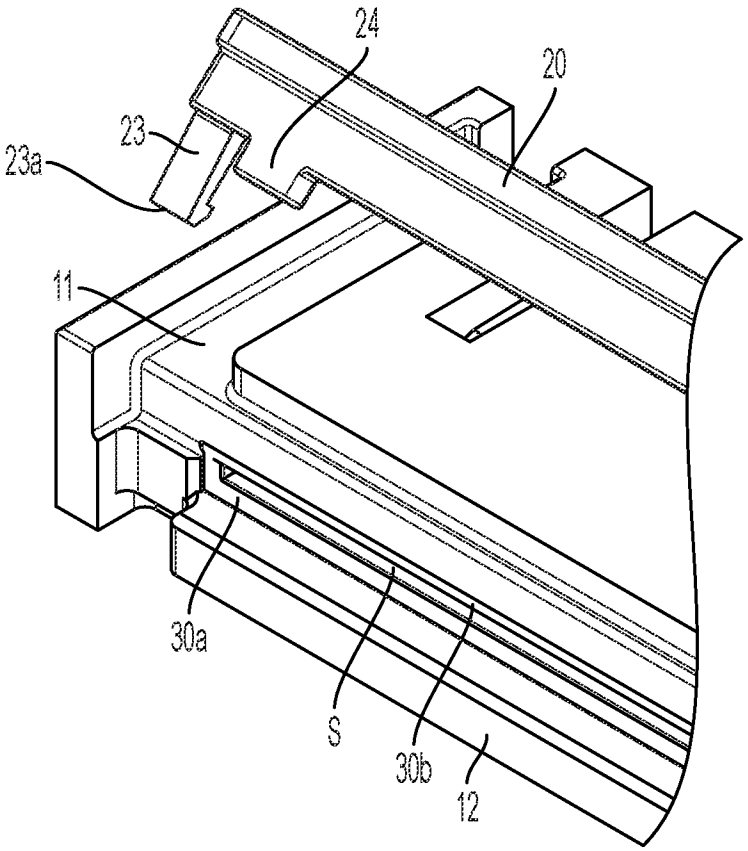
FIG. 4B is an enlarged portion of this view.
Figure 4A:
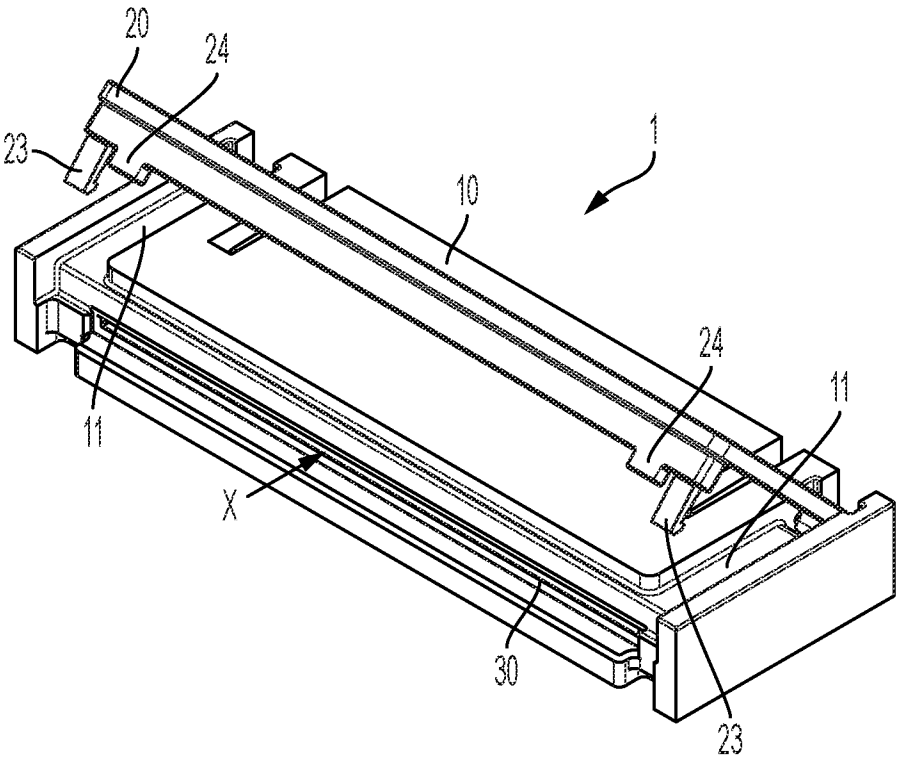
FIG. 4A is a front top perspective view of the electrical connector of FIG. 1 with the actuator of FIG. 3 in in an opened position.
Figure 5B:
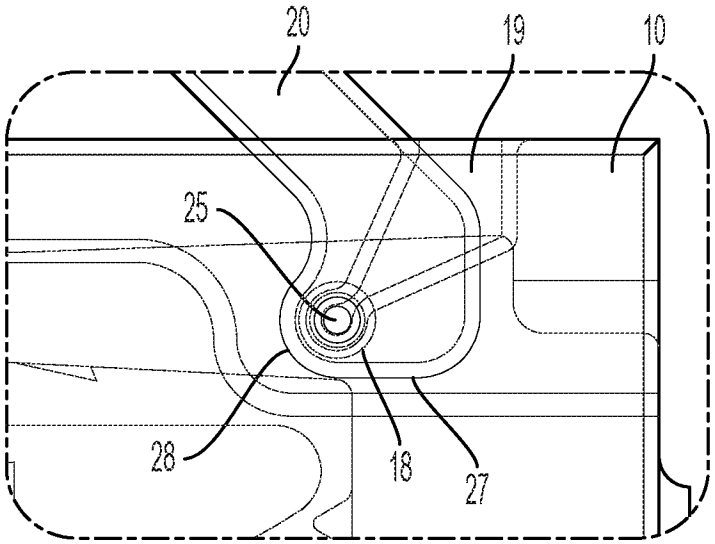
FIG. 5B shows an enlarged portion of this view.
Figure 5A:
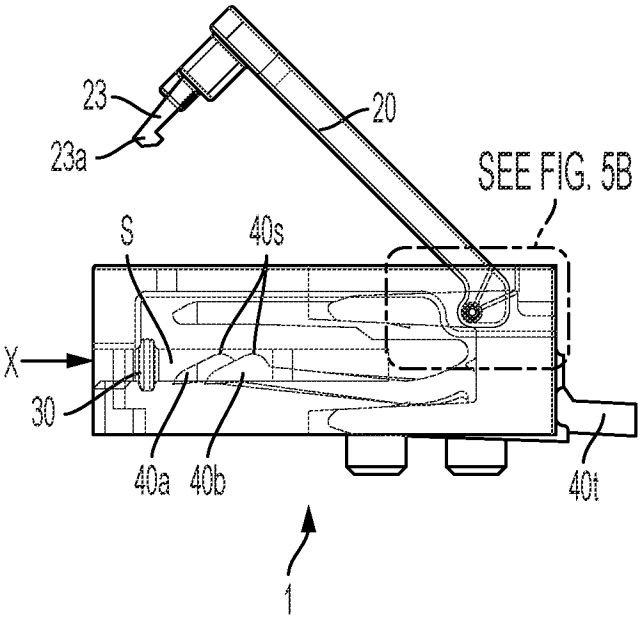
FIG. 5A is a partially transparent side elevational view of the electrical connector of FIG. 1 with the actuator in the opened position.

FIG. 4A shows a front top perspective view of the connector 1 with the actuator 20 in the opened position, and FIG. 4B shows an enlarged portion of this view. Similarly, FIG. 5A shows a partially transparent side elevational view of the connector 1 with the actuator 20 in the opened position, and FIG. 5B shows an enlarged portion of this view.

As shown in FIGS. 4A-5B, an upper surface of the housing 10 may include trenches or actuator grooves 11, which are configured to accommodate the side arms 22 of the actuator 20 when the actuator 20 is in the closed position. The actuator grooves 11 may be sufficiently deep such that, in the closed position, an upper surface of the side arms 22 may be flush or even with the upper surface of the housing 10. This evenness of the surfaces may be used advantageously by a user to ascertain visually when the actuator 20 is in the closed position and the mated member is locked in the connector 1.

The housing 10 may include a front ledge 12 on which a portion of the main arm 21 of the actuator 20 may rest when the actuator 20 is in the closed position. The seal groove 14 may be located at an inner portion of the ledge 12 (see FIG. 2, which shows only a lower portion of the seal groove 14). In some embodiments of the present technology, in an assembled state of the connector 1, the resilient member 30 may be formed of a continuous loop of material that is seated in the seal groove 14. When seated in the seal groove, a slot-shaped hole of the loop of the resilient member 30 may form an entrance to a slot S of the housing 10. The slot S may be configured to receive the connection portion of the mating member therein by insertion in an insertion direction X.

Alternatively, in some embodiments of the present technology, the resilient member 30 may be formed of separate sections having ends that meet to form a loop. For example, as shown in FIG. 4B, the resilient member 30 may include a U-shaped lower portion 30*a* and a bar-shaped upper portion 30*b*. Respective ends of the upper and lower portions 30*a*, 30*b* may be compressively joined when the connector 1 is in the assembled state, thus forming a loop that may be as seal-tight as a continuous loop (i.e., a loop without joined sections).

The housing 10 may include guide grooves 19 located in sidewalls of the actuator grooves 11, which may be used to guide the free ends of the side arms 22 of the actuator 20. For example, the pivot protrusions 25 of the side arms 22 may slide along the guide grooves 19 and may snap into pivot holes 18 in the guide grooves 19. That is, a depth of the pivot holes 18 may be greater than a depth of the guide grooves 19 such that, when the actuator 20 is properly attached to the housing 10, the pivot protrusions 25 fall into the pivot holes 18.

As will be appreciated, the pivot protrusions 25 of the actuator 20, and the pivot holes 18 of the housing 10 form a pivoting mechanism that enables the actuator 20 to pivot relative to the housing 10, from the opened position (FIG. 4A) to the closed position (FIG. 1). During pivoting of the actuator 20, a curved pivot surface 28 at the free ends of the side arms 22 may be rotated relative to a curved portion of the actuator groove 11 facing the pivot surface 28. As mentioned above, a portion of the main arm 21 of the actuator 20 may rest on the ledge 12 of the housing 10 when the actuator 20 is in the closed position. When the actuator 20 is in the opened position, to prevent the actuator 20 from being pivoted to beyond a maximum angle, the free ends of the side arms 22 may include a stop surface 27 that bumps into a surface of the housing 10 to prevent further rotational movement. For example, the stop surface 27 may have one end connected to an end of the pivot surface 28 and an opposite end that comes into contact with the surface of the housing 10 when the actuator is at its maximum angle relative to the housing 10. The stop surface 27 may have a flat central portion corresponding to a rest position of the actuator 20 when the actuator 20 is in the opened position.

The electrical contacts 40 may be held in the housing 10 such that contact surfaces 40*s* of the contacts 40 are exposed in the slot S and are configured to make physical contact with the mating member when the connection portion of the mating member is inserted into the slot S. The contacts 40 may include a plurality of types of contacts. For example, included in the contacts 40 may be a first type of contact 40*a* (e.g., a signal contact) and a second type of contact 40*b* (e.g., a ground contact). As can be seen in the partially transparent view of FIG. 5A, the connection portion of the mating member may enter the slot S in the direction X via the hole in the loop of the resilient member 30. During entry into the slot S, contact pads on the connection portion of the mating member may come into contact with the contact surfaces 40*s*. The contacts 40 may be configured to flex slightly and push against the connection portion of the mating member, to ensure good electric conduction between the contacts 40 and the mating member. The contacts 40 may have contact tails 40*t* configured to connect electrically with a PCB or other type of substrate on which the connector 1 is mounted.

The mating member may be a FFC, or a FPC, or another type of flat member that has sufficient rigidity to be inserted into the slot S. For example, the mating member may be located at an end of a ribbon cable to provide an electrical connection between the ribbon cable and the connector 1. In some embodiments of the present technology, the mating member may be a FFC. FIG. 6A shows a top perspective view of a connection portion 70 of the FFC prior to insertion in the connector 1. The connection portion 70 may include one or more retention tab(s) 71 that extend laterally from a connection direction of the connection portion 70. For example, the connection direction may be parallel to the insertion direction X when the connection portion 70 is mated to the connector 1. Each of the retention tab(s) 71 may include a retention tab edge 72 configured to come into contact with the blocking protrusion(s) 24 of the actuator 20.

Figure 6B:
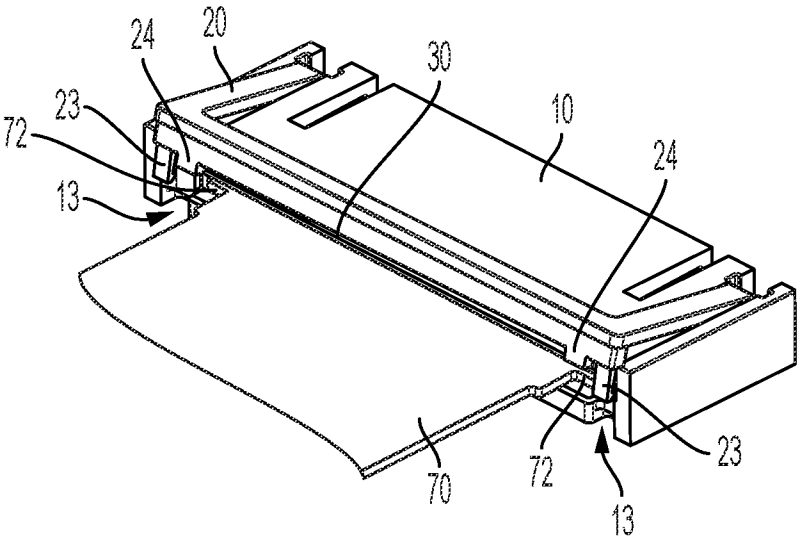
FIG. 6B shows the mating member after insertion and in an unlocked state.
Figure 6A:
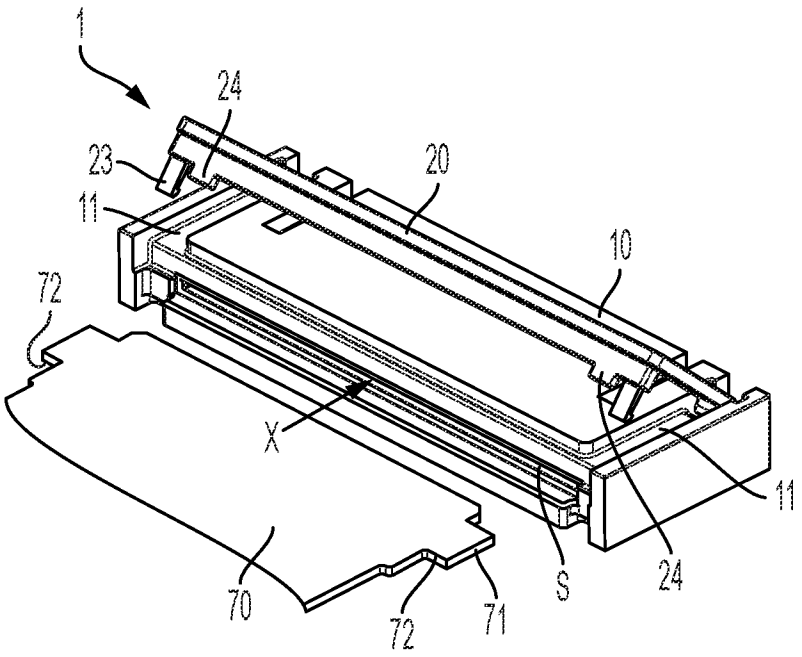
FIG. 6A is a top perspective view of a mating member (e.g., a FFC or a FPC) prior to insertion in the electrical connector of FIG. 1.

FIG. 6B shows the connection portion 70 of the FFC after the connection portion 70 has been fully inserted in the slot S. In FIG. 6B, the actuator 20 has pivoted from the fully opened state (FIG. 6A) but is not yet in the closed state. As shown in FIG. 6B, in the fully inserted state, the resilient member 30 may completely encircle the connection portion 70 at a region that may include the retention tab(s) 71. In some embodiments of the present technology, the retention tab edge(s) 72 may align with a portion of the housing 10 to provide the user with a visual indication that the connection portion 70 has been fully inserted in the slot S.

The housing 10 may include one or more latching indent(s) 13 configured to accommodate the latching protrusion(s) 23 of the actuator 20 when the actuator 20 is in the closed position. The arrangement of the latching protrusion(s) 23 and the blocking protrusion(s) 24 may be such that the actuator 20 may not be placed in the closed position if the connection portion 70 of the FFC is not fully inserted in the slot S. For example, the latching protrusion(s) 23 and/or the blocking protrusion(s) 24 may hit a surface of the retention tab(s) 71 if there is an attempt to close the actuator 20 while the connection portion 70 is not oriented properly with respect to the housing 10.

Figure 6D:
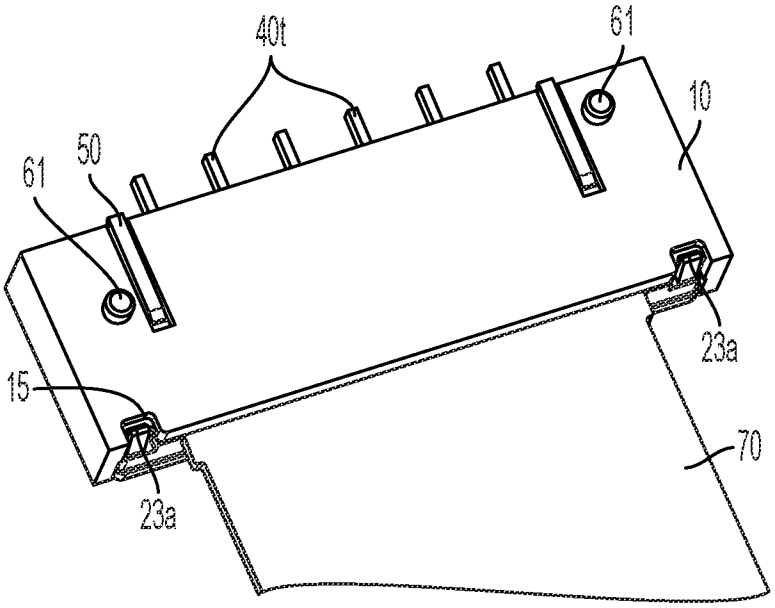
FIG. 6D shows a bottom perspective view of the mating member after insertion and in a locked state.
Figure 6C:
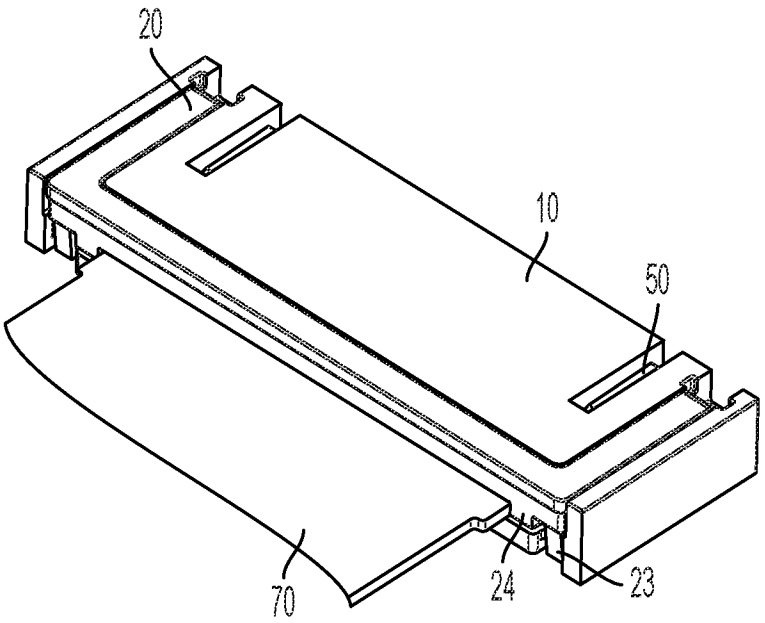
FIG. 6C shows a top perspective view of the mating member after insertion and in a locked state.

FIG. 6C shows the connection portion 70 of the FFC and the connector 1 after the connection portion of the connection portion 70 has been inserted in the slot S and after the actuator 20 has been pivoted to the closed position, i.e., when the connector 1 is in the locked state. FIG. 6D shows a bottom perspective view of the connection portion 70 and the connector 1 in the locked state.

When the connection portion 70 of the FFC is fully inserted in the slot S and the connector 1 is in the locked state, the connection portion 70 may be prevented from shifting and/or moving out of the slot S by the blocking protrusion(s) 24. For example, each of the blocking protrusion(s) 24 may have a surface that engages with a corresponding one of the retention tab edge(s) 72 of the connection portion 70.

Each of the latching protrusion(s) 23 may include a latching hook 23*a* (FIG. 5A) configured to latch onto a corresponding one of one or more latching bottom surface(s) 15 of the housing 10. In some embodiments of the present technology, the latching bottom surface(s) 15 may be recessed and may be structured to cause an audible sound (e.g., a click) to be produced when the latching protrusion(s) 23 is or are snapped closed. For example, the latching bottom surface(s) 15 may cause an audible click to be generated by friction when the latching hook(s) 23*a* move(s) across one or more ridge(s) of the latching bottom surface(s) 15. Each of the latching hook(s) 23 may hook to an external corner of a corresponding one of the latching bottom surface(s) 15.

The actuator 20 may be configured to cause a force to be applied to the resilient member 30 when the actuator 20 is in the closed position. That is, in the closed position, the resilient member 30 may be under a compressive force that may cause the resilient member 30 to form a seal with a surface in contact with the resilient member 30. For example, when the connecting portion 70 of the FFC is fully inserted in the slot S and the actuator 20 is in the closed position such that the connection portion 70 is locked in the connector 1, the resilient member 30 may provide a seal between the housing 10 and the connection portion 70, thus preventing, e.g., moisture and/or debris from entering the slot S. In some embodiments of the present technology, the seal may be such that the connector 1 may have an IP rating of IP5K4 under DIN 40050 standards, making the connector 1 suitable for use in, e.g., automobiles.

As will be appreciated, although the connector 1 is described to have the latching protrusion(s) 23 separate from the blocking protrusion(s) 24, in some embodiments of the present technology a single protrusion (not shown) may serve to latch the actuator 20 to the housing 10, when the actuator 20 is in the closed position, and also to block the connection portion 70 of the FFC from being disconnected from the connector 1 when the actuator 20 is in the closed position.

Optionally, a bottom surface of the housing 10 may include peg protrusions 61 configured to be received in receiving holes of a PCB or substrate on which the connector 1 is to be mounted. The peg protrusions 61 may be arranged asymmetrically on the housing 10 so that the connector 1 may be mounted only in a single orientation on the PCB or substrate.

Figure 7A:
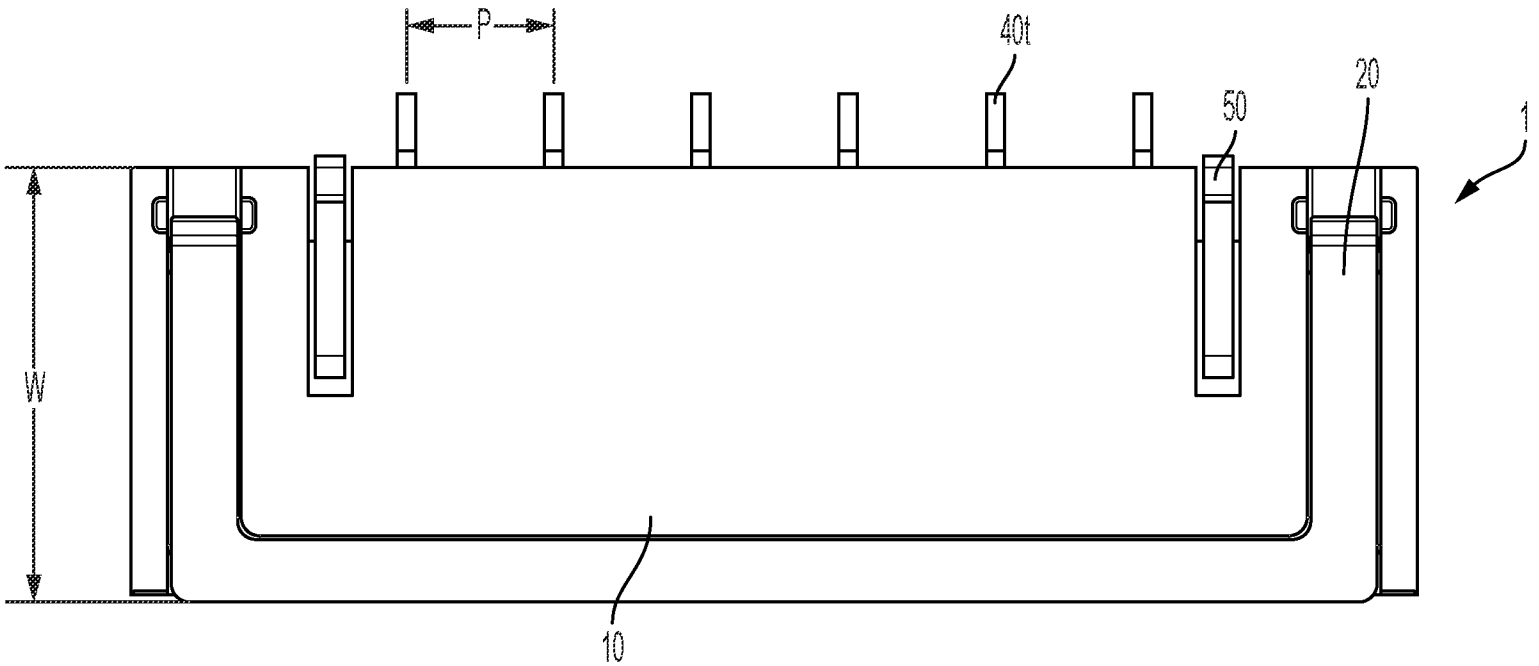
FIG. 7A is a top plan view of the electrical connector of FIG. 1.
Figure 7B:
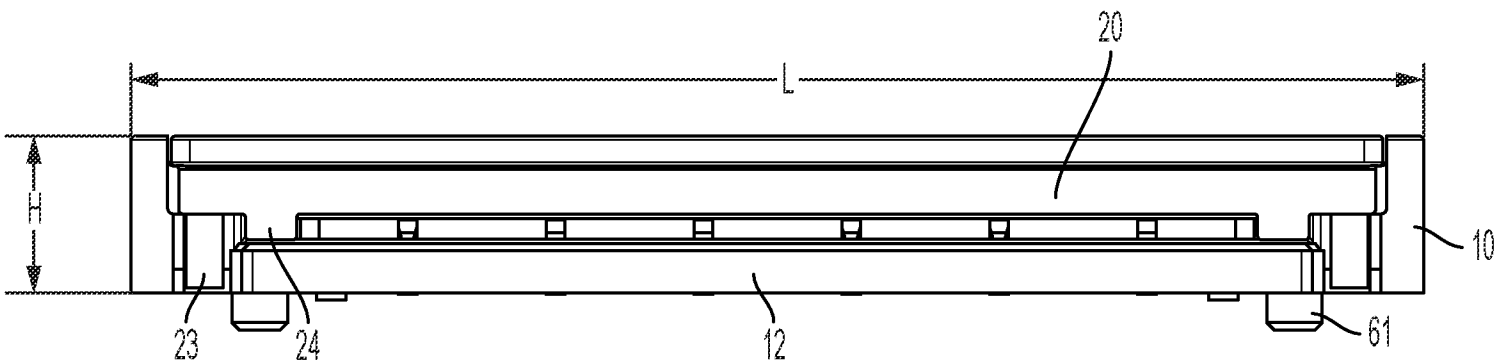
FIG. 7B is a front elevational view of this connector.

FIG. 7A shows a top plan view of the connector 1, and FIG. 7B shows a front elevational view of the connector 1. The housing 10 may have a generally rectangular shape, when viewed from the top. The contact tails 40*t* may extend from a rear side of the housing 10, opposite to a front side on which is located the entrance to the slot S. The connector 1 may have a low profile, such that a height H of the housing 10 may be about 3 mm or less. In some embodiments of the present technology, the height H may be about 2.6 mm or less, or about 2.4 mm or less, or even about 2.2 mm or less. The housing 10 may have a width W (i.e., a distance from the front side of the housing 10 to the rear side of the housing 10) in a range of about 10 mm or less, or about 8 mm or less, or even about 6 mm or less. A side-to-side length L of the connector 1 may depend on a number of contacts 40 housed in the housing 10. For example, the connector 1 may include six contacts 40 at a pitch P of about 3 mm or less, or about 2.5 mm or less, or even about 2 mm or less. In this example, the length L of the connector 1 may be about 24 mm or less, or 20 mm or less, or even 16 mm or less.

Figure 8B:
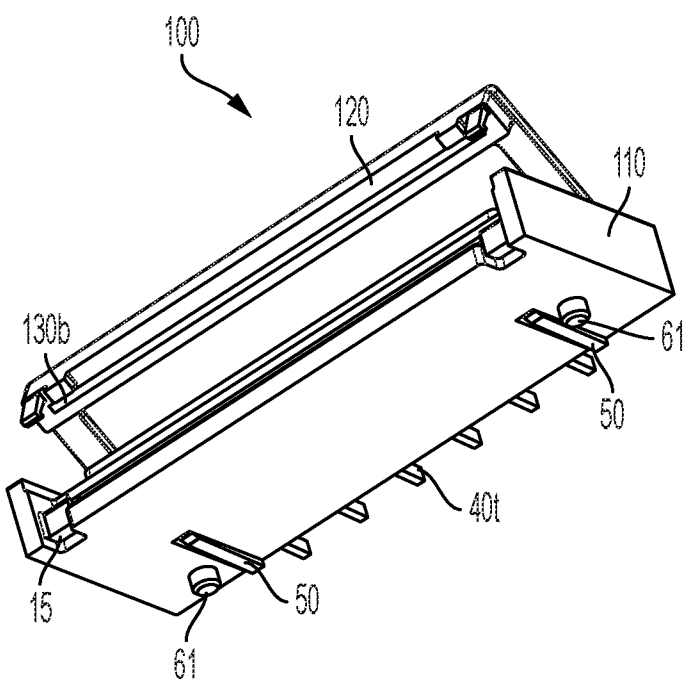
FIG. 8B is a front bottom perspective view of this connector.
Figure 8A:
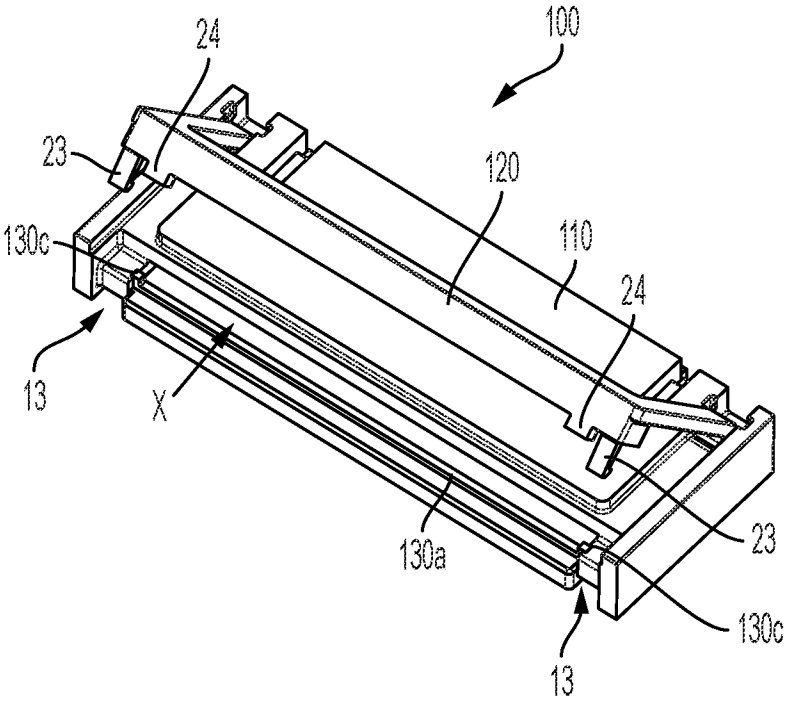
FIG. 8A is a front top perspective view of an electrical connector, according to some embodiments of the present technology.
Figure 9:
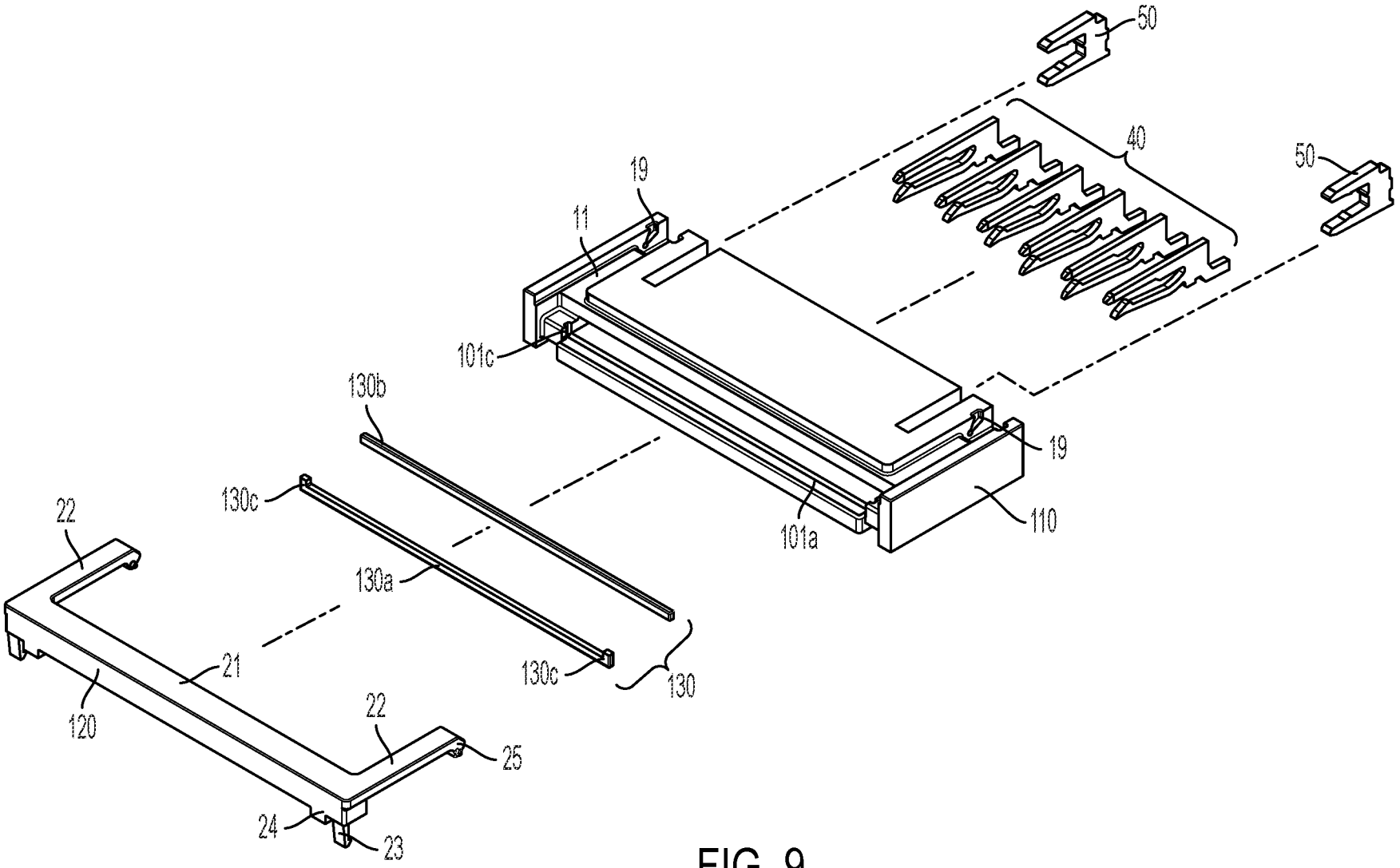
FIG. 9 is a front top perspective view of the electrical connector of FIG. 8A in a disassembled state.

FIG. 8A shows a front top perspective view of a sealable electrical connector 100, according to some embodiments of the present technology. FIG. 8B shows a front bottom perspective view of the connector 100. Aspects of the connector 100 that may be the same as or similar to the connector 1 may have the same reference numerals; in such cases, duplicate descriptions may not be repeated herein. FIG. 9 shows a front top perspective view of the connector 100 in a disassembled state.

The connector 100 may include a housing 110 and an actuator 120 pivotably connected to the housing 110 in a similar manner as in the connector 1. The connector 100 is shown in the opened position in FIGS. 8A and 8B.

The connector 100 may include a resilient sealing member 130 formed of multiple portions that may be separate from each other when the connector 100 is in the opened position. For example, the sealing member 130 may be a "split" member that may include a lower sealing section 130*a* configured to be seated in the housing 110, and an upper sealing section 130*b* configured to be seated in the actuator 120. The lower sealing section 130*a* may include upturned ends 130*c* configured to come into contact with the upper sealing section 130*b* when the actuator 120 is in the closed position, to form a loop. The sealing member 130 may be formed of a polymeric elastomer that may deform under pressure, similar to the resilient member 30. Also, similar to the resilient member 30, when pressure is applied to the sealing member 130, a seal may be formed between the sealing member 130 and surfaces to which the sealing member 130 is in contact.

Figure 10B:
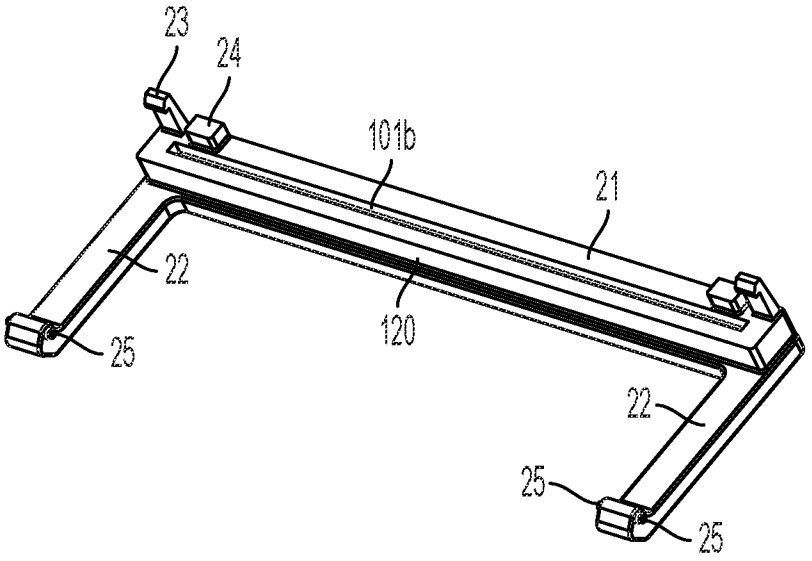
FIG. 10B is a rear bottom perspective view of an actuator of this connector.
Figure 10A:
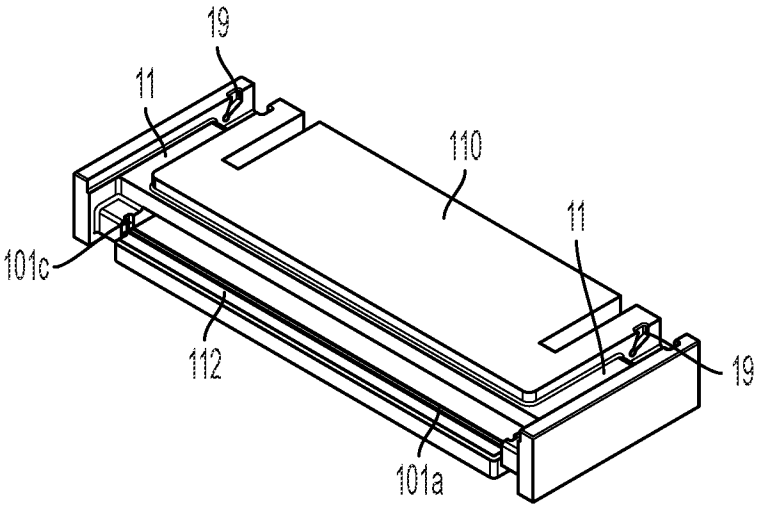
FIG. 10A is a front top perspective view of a housing of the electrical connector of FIG. 8A.

FIG. 10A shows a front top perspective view of the housing 110, and FIG. 10B shows a rear bottom perspective view of the actuator 120. The housing 110 may include a ledge 112, similar to the ledge 12 of the connector 1. The ledge 112 may include a lower seal groove 101*a* configured to accommodate or seat the lower sealing section 130*a* of the sealing member 130. Ends of the lower seal groove 101*a* may include upturned groove portions 101*c* configured to accommodate the upturned ends 130*c* of the lower sealing section 130*a*. An underside of the actuator 120 may include an upper seal groove 101*b* configured to accommodate or seat the upper sealing section 130*b* of the sealing member 130. When the actuator 120 is in the opened position, the upper sealing section 130*b* may be physically separate from the lower sealing section 130*a* as well as from the upturned ends 130*c* of the lower sealing section 130*a*. When the actuator 120 is in the closed position, the upper sealing section 130*b* may touch the lower sealing section 130*a* via the upturned ends 130*c* of the lower sealing section 130*a*. As will be appreciated, although the upper sealing section 130*b* is shown to be bar shaped and devoid of bends and/or curves, in some embodiments of the present technology the upper sealing section 130*b* may have, e.g., downturned ends configured to come into contact with the lower sealing section 130*a*, which may or may not include the upturned ends 130*c*. That is, the sealing member 130 is not limited to sections shaped as shown in FIG. 9 but instead may include sections of different shapes, provided that the different shapes form a sealing loop when the actuator 120 is in the closed position. When the connection portion 70 of the FFC is inserted in the slot S (see FIG. 16A) of the housing 110 via the hole in the sealing loop formed by the sections of the sealing member 130, and when the actuator 120 is pivoted to the closed position such that the actuator 120 is latched to the housing 110, pressure may be applied to the sections of the sealing member 130 to cause a continuous seal to be formed between the sealing member 130 and the connection portion 70, preventing moisture and/or debris from entering the slot S of the housing 110.

Figure 11B:
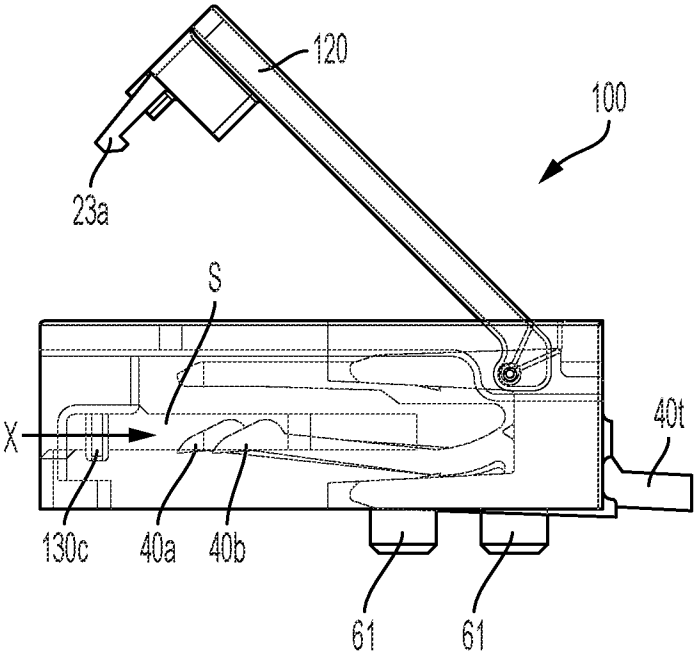
FIG. 11B is a partially transparent side elevational view of this connector.
Figure 11A:
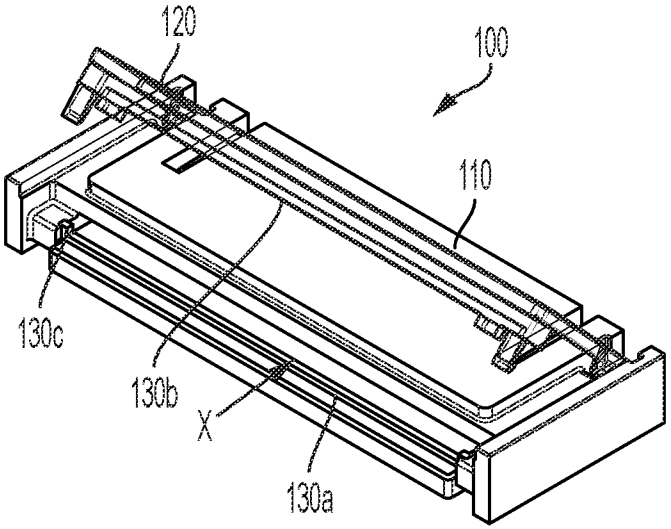
FIG. 11A is a front top perspective view of the electrical connector of FIG. 8A with the actuator of FIG. 10B in an opened position.

FIG. 11A shows a front top perspective view of the 100, in which the actuator 120 is transparent so that the upper sealing section 130*b* may be seen. FIG. 11B shows a partially transparent side elevational view of the connector 100. As can be seen from these views, the sealing member 130 may not form the continuous sealing loop until the actuator 120 is in the closed position.

Figure 12B:
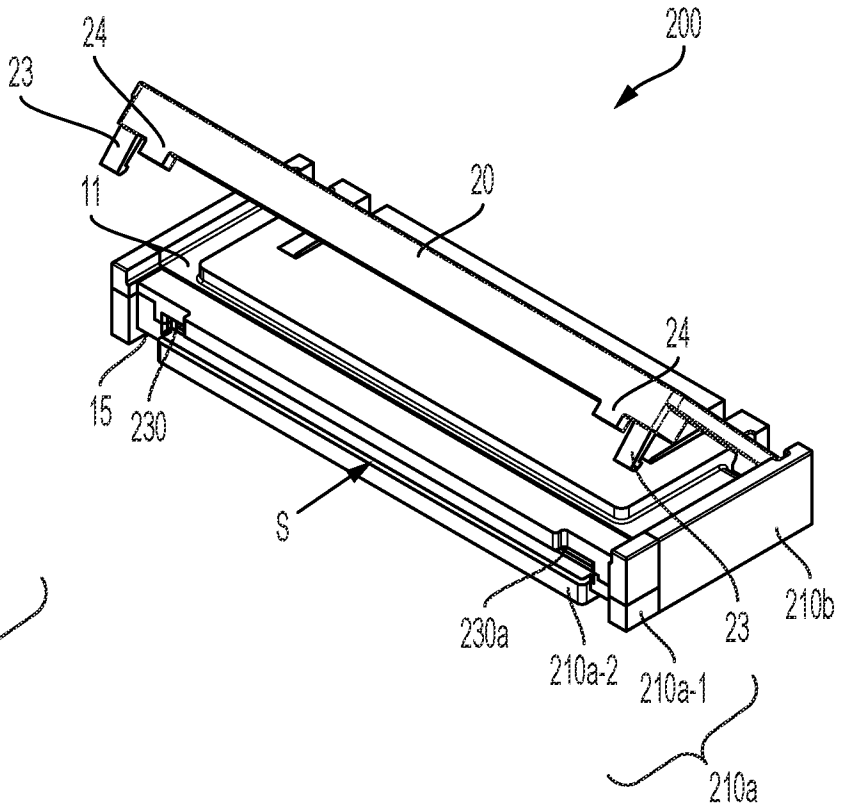
FIG. 12B is a solid rendering of this connector in the same view.
Figure 12A:
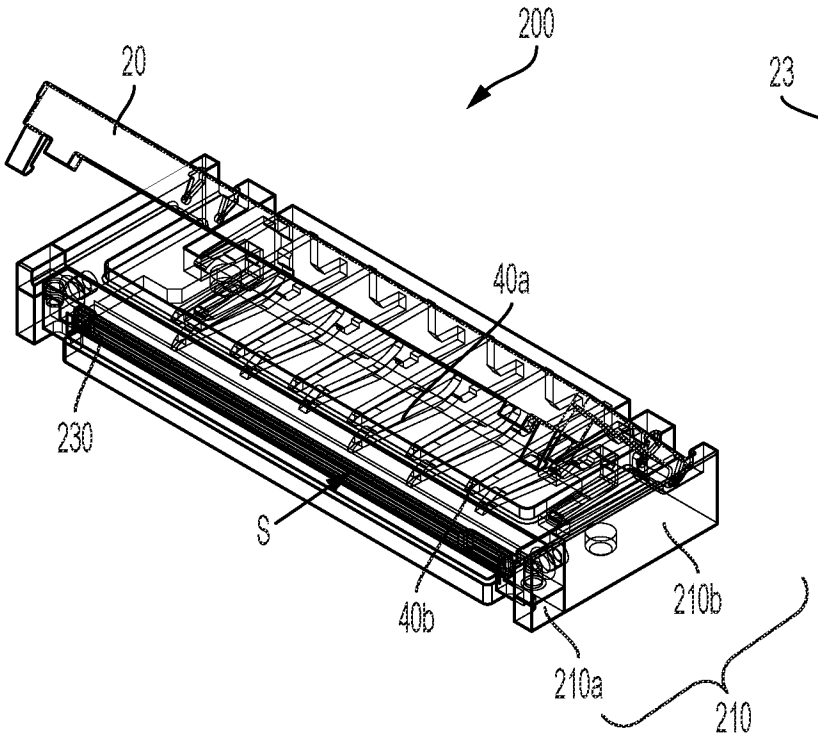
FIG. 12A is a partially transparent front top perspective view of an electrical connector having an actuator in an opened state, according to some embodiments of the present technology.
Figure 13:
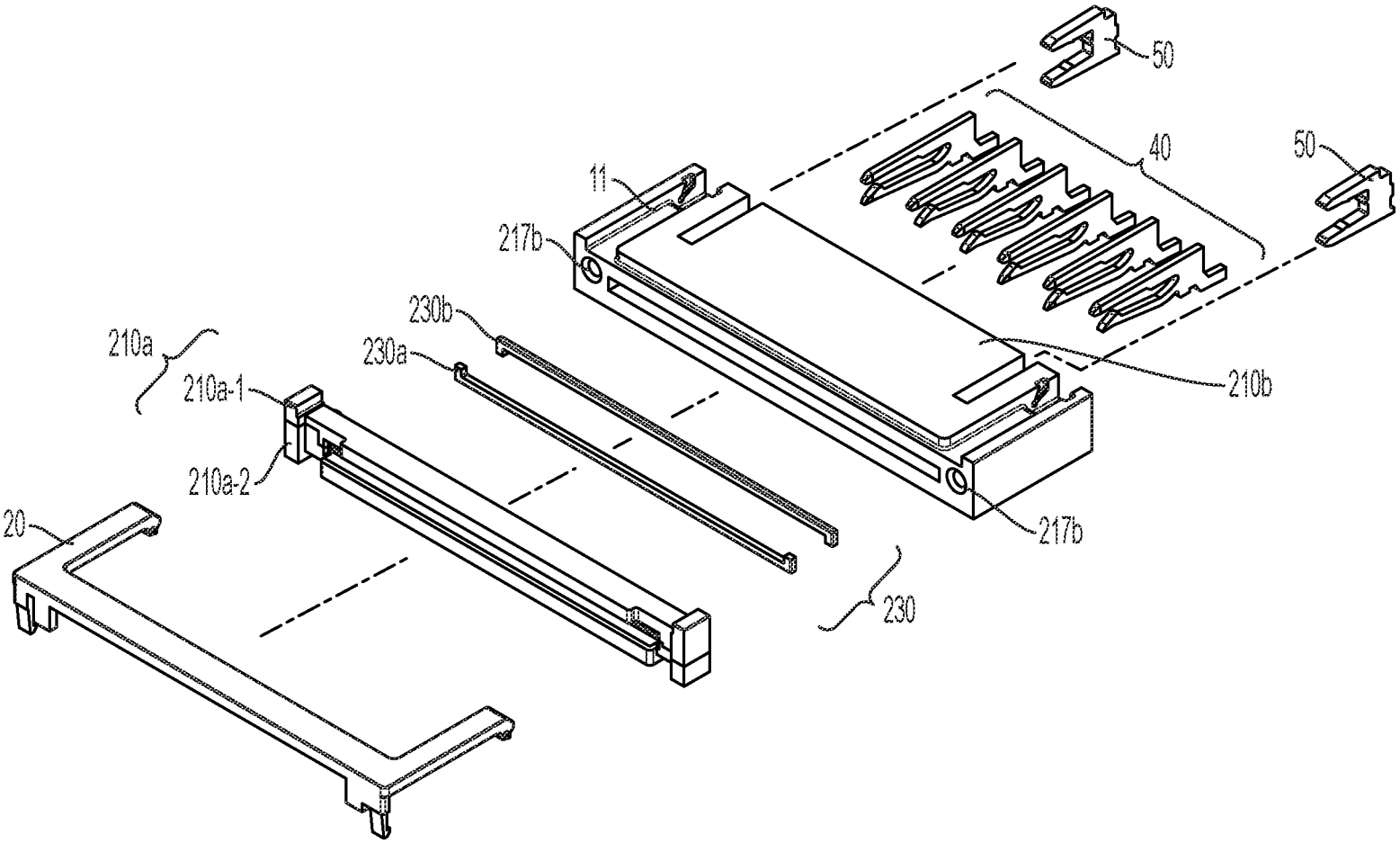
FIG. 13 is a front top perspective view of the connector of FIG. 12A in a disassembled state.

FIG. 12A shows a partially transparent front top perspective view of a sealable electrical connector 200, according to some embodiments of the present technology, and FIG. 12B shows a solid rendering of the connector 200. Aspects of the connector 200 may be the same as or similar to the connector 1 and/or the connector 100, and therefore may have the same reference numerals; in such cases, duplicate descriptions may not be repeated herein. FIG. 13 shows a front top perspective view of the connector 200 in a disassembled state.

The connector 200 may include a housing 210 and an actuator 20 pivotably connected to the housing 210 in a similar manner as in the connector 1 and the connector 100. The connector 200 is shown in the opened position in FIGS. 12A and 12B.

The connector 200 may include a housing 210 formed of a front housing portion 210*a* and a rear housing portion 210*b*. The front housing portion 210*a* may be configured to support a resilient sealing member 230. Similar to the connector 1 and the connector 100, the contacts 40 of the connector 200 may be supported in the rear housing portion 210*b* such that the contact tails 40*t* may extend out of a rear surface of the rear housing portion 210*b* (see FIG. 16B).

Figure 14B:
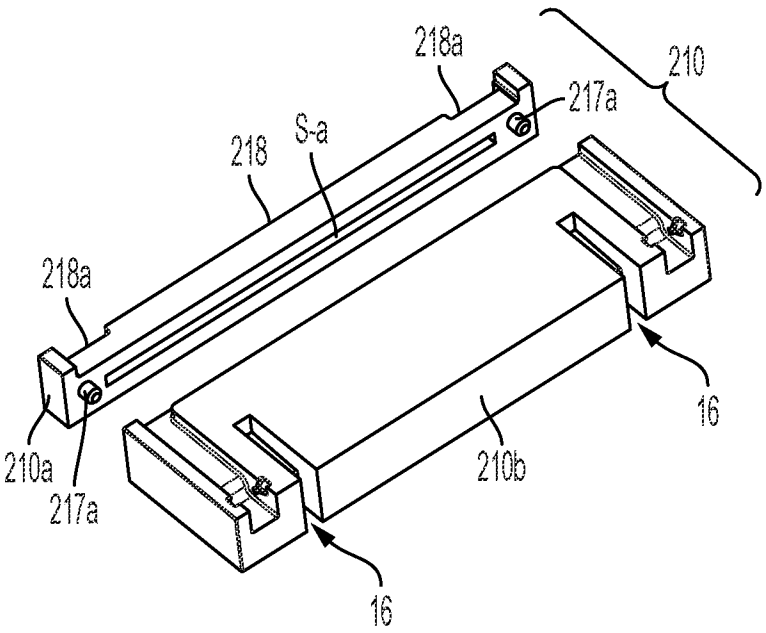
FIG. 14B is a rear top perspective view of this housing in the disassembled state.
Figure 14A:
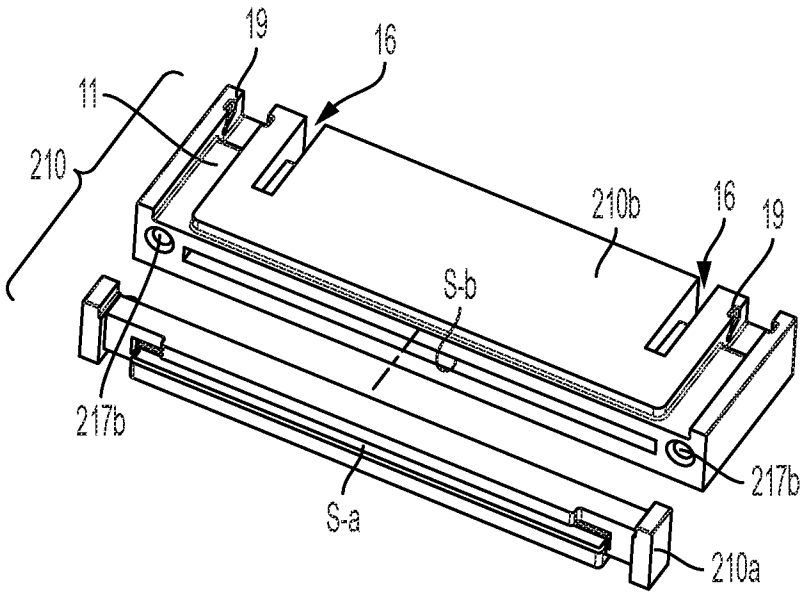
FIG. 14A is a front top perspective view of a housing of the electrical connector of FIG. 12A in a disassembled state.
Figure 15B:
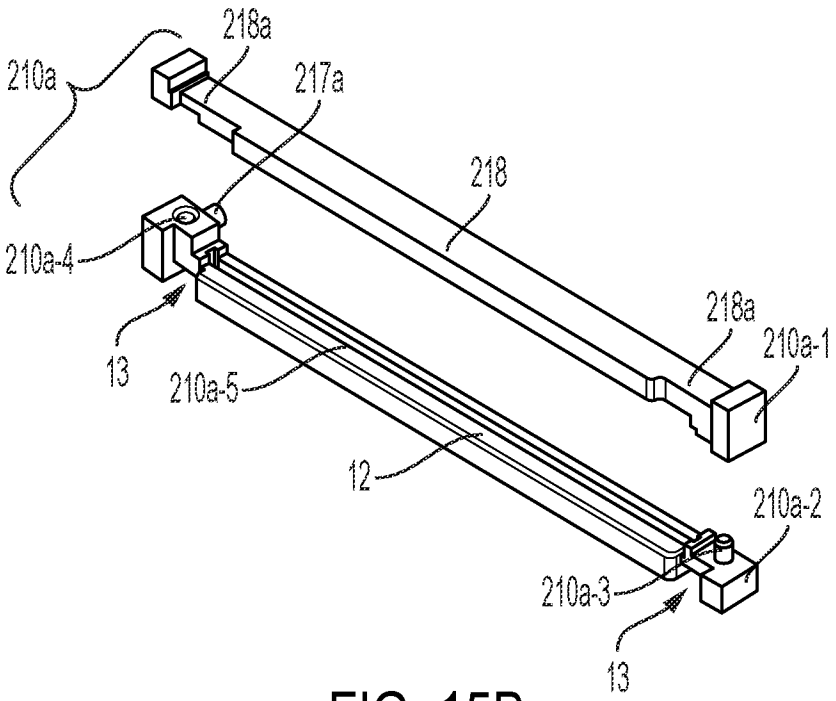
FIG. 15B is a front top perspective view of this front housing portion in the disassembled state.
Figure 15A:
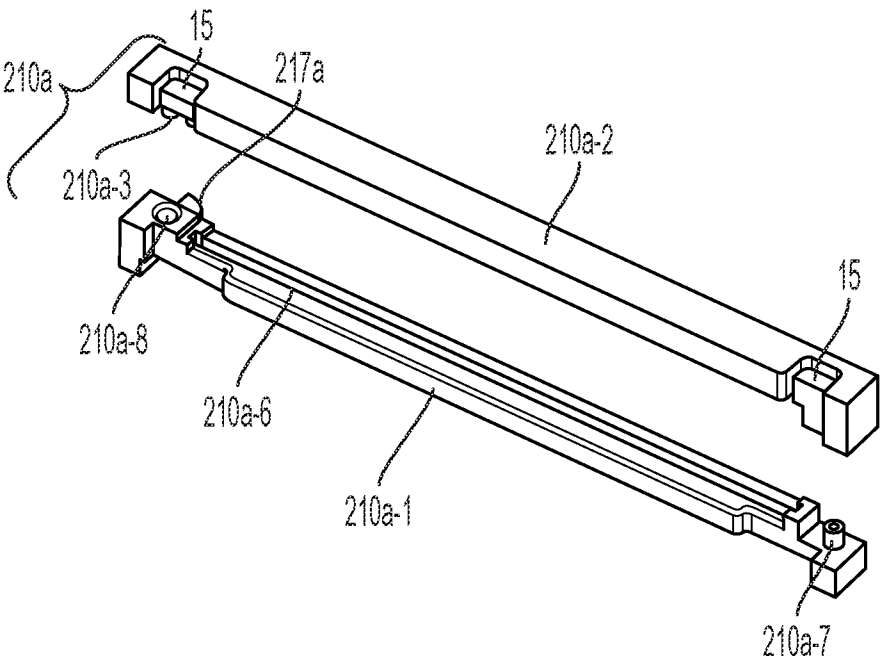
FIG. 15A is a front bottom perspective view of a front housing portion of the housing of FIG. 14A in a disassembled state.

FIG. 14A shows a front top perspective view of the housing 210 in a disassembled state, and FIG. 14B shows a rear top perspective view of the housing 210 in the disassembled state. FIG. 15A shows a front bottom perspective view of the front housing portion 210*a* in a disassembled state, and FIG. 15B shows a front top perspective view of the front housing portion 210*a* in the disassembled state. A rear surface of the front housing portion 210*a* may include pegs 217*a* configured to engage with and seat in corresponding peg-receiving holes 217*b* located in a front surface of the rear housing portion 210*b*. The pegs 217*a* and the peg-receiving holes 217*b* may be configured to ensure that the front and rear housing portions 210*a*, 210*b* fit together properly when the housing 210 is assembled. For example, when the front and rear housing portions 210*a*, 210*b* are properly joined together, a front portion S-a of the slot S, located in the front housing portion 210*a*, may align with a rear portion S-b of the slot, located in the rear housing portion 210*b* (see FIG. 16B). In some embodiments of the present technology, the front and rear housing portions 210*a*, 210*b* may be formed of an insulative material (e.g., plastic) and may be joined together by, e.g., ultrasonic welding. Alternatively, the front and rear housing portions 210*a*, 210*b* may be held together by friction and by the actuator 20, when the actuator 20 is in the closed position. In the latter case, by not fusing or welding together the front and rear housing portions 210*a*, 210*b*, a user may be able to replace the front housing portion 210*a* when, e.g., the sealing member 230 is damaged.

The sealing member 230 may be formed of a single portion, similar to the resilient member 30 in FIG. 2, or may be formed of multiple portions, similar to the resilient sealing member 130 in FIG. 9. In some embodiments of the present technology, the sealing member 230 may be a split member that may include a bottom sealing section 230*a*, which may be configured to seat in a bottom seal groove 210*a*-5 of a bottom section 210*a*-2 of the front housing portion 210*a*, and a top sealing section 230*b*, which may be configured to seat in a top seal groove 210*a*-6 of a top section 210*a*-1 of the front housing portion 210*a*. The bottom sealing section 230*a* may include upturned ends configured to contact and seal with downturned ends of the top sealing section 230*b* when the bottom and top sections 210*a*-1, 210*a*-2 of the front housing portion 210 are assembled together, to form a loop. The sealing member 230 may be formed of a polymeric elastomer that may deform under pressure, similar to the resilient member 30 and the resilient sealing member 130. When pressure is applied to the sealing member 230, a seal may be formed between the sealing member 230 and surfaces to which the sealing member 230 is in contact.

The top section 210*a*-1 of the front housing portion 210*a* may include a top peg 210*a*-7 and a top hole 210*a*-8. The bottom section 210*a*-2 of the front housing portion 210*a* may include a bottom peg 210*a*-3 and a bottom hole 210*a*-4. The front housing portion 210*a* may be assembled by seating the bottom sealing section 230*a* in the bottom seal groove 210*a*-5, seating the top sealing section 230*b* in the top seal groove 210*a*-6, inserting the top peg 210*a*-7 in the bottom hole 210*a*-4, and inserting the bottom peg 210*a*-3 in the top hole 210*a*-8. When the top and bottom pegs 210*a*-7, 210*a*-3 and the bottom and top holes 210*a*-4, 210*a*-8 are properly joined to form the loop, the ends of the top and bottom sealing sections 230*b*, 230*a* form sealed interfaces. The top and bottom sections 210*a*-1, 210*a*-2 of the front housing portion 210*a* may be fused together by, e.g., ultrasonic welding. As shown in FIGS. 15A and 15B, each of the top and bottom sections 210*a*-1, 210*a*-2 of the front housing portion 210*a* may include at least one peg 217*a*.

The front housing portion 210*a* may have a front edge 218 with one or more recess(es) 218*a*. The recess(es) 218*a* may be structured to accommodate the latching protrusion(s) 23 and the blocking protrusion(s) 24 of the actuator 20 when the actuator 20 is in the closed position. When the connector 200 is seen in a top plan view, similar to the view shown in FIG. 7A, a generally rectangular shape may appear for the housing 210.

Figure 16B:
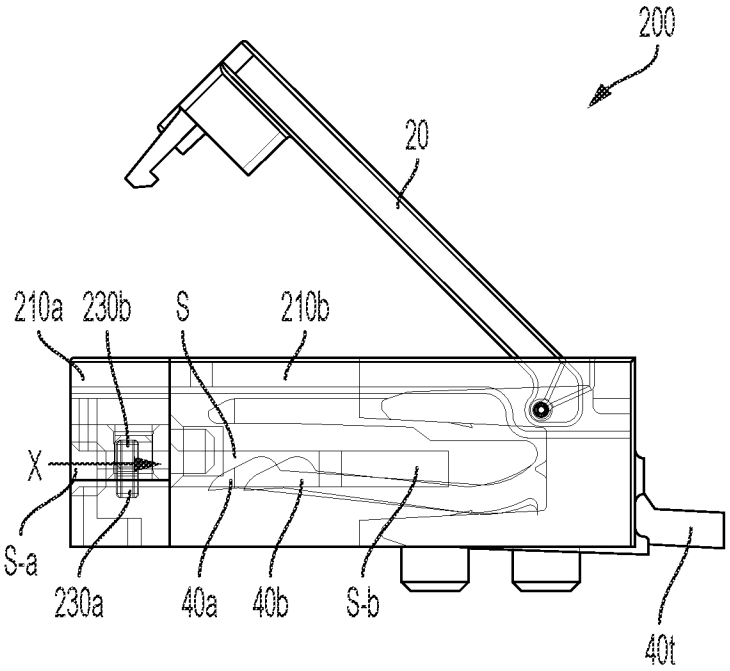
FIGS. 16A and 16B are partially transparent side elevational views of the electrical connector of FIG. 8A and the electrical connector of FIG. 12A, respectively.
Figure 16A:
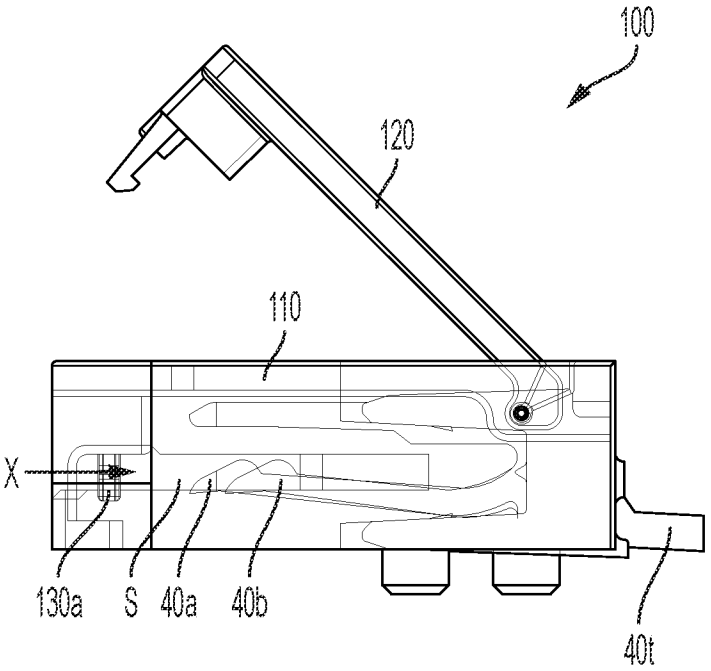

FIGS. 16A and 16B show partially transparent side elevational views of the connector 100 and the connector 200, respectively. The structure of the connector 100 may enable the sealing member 130 to be replaced easily, when the actuator 120 is in the opened position, without replacing other portions of the connector 100. The structure of the connector 200 is such that, if the front and rear housing portions 210*a*, 210*b* are not welded together, the front housing portion 210*a* may be a replaceable portion, as mentioned above.

An electrical connector according to the technology described herein may be embodied in different configurations. Example configurations include combinations of configurations (1) through (24), as follows:

(1) An electrical connector comprising: a housing having a slot configured to receive a mating component; a plurality of contacts held in the housing and configured to be in electrical contact with the mating component when the mating component is in a mated position in the slot; a resilient member having at least a portion supported by the housing; an actuator pivotably coupled to the housing and configured to have: an opened position in which the mating component may be inserted in the slot, and a closed position in which a biasing force is applied on the resilient member such that, when the mating component is in the mated position in the slot, the resilient member provides a moisture-resistant seal around a surface of the mating component.

(2) The electrical connector of configuration (1), wherein the actuator includes at least one latching protrusion configured to latch with the housing when the actuator is in the closed position.

(3) The electrical connector of any of configurations (1) through (2), wherein each latching protrusion is configured to produce an audible sound when the actuator is pivoted to the closed position.

(4) The electrical connector of any of configurations (1) through (3), wherein the actuator includes a longitudinal arm, and the at least one latching protrusion includes: a first latching protrusion protruding from a first part of the arm, and a second latching protrusion protruding from a second part of the arm.

(5) The electric connector of any of configurations (1) through (4), wherein the actuator includes at least one blocking protrusion configured to face a blocking surface of the mating component when the mating component is in the mated position and the actuator is in the closed position.

(6) The electrical connector of any of configurations (1) through (5), wherein the housing includes a ledge configured to stop the actuator from pivoting beyond the closed position.

(7) The electrical connector of any of configurations (1) through (6), wherein the at least one blocking protrusion includes a lower surface that contacts a top surface of the ledge when the actuator is in the closed position.

(8) The electrical connector of any of configurations (1) through (7), wherein the resilient member includes a lower seal portion and an upper seal portion, the housing includes a ledge with a lower seal groove configured to receive the lower seal portion, the actuator includes a longitudinal arm with an upper seal groove configured to receive the upper seal portion, and, when the actuator is in the opened position, the lower seal portion does not directly contact the upper seal portion.

(9) The electrical connector of any of configurations (1) through (8), wherein the lower seal portion includes upturned ends each configured to contact the upper seal portion when the actuator is in the closed position.

(10) The electrical connector of any of configurations (1) through (9), wherein the upper seal portion is shaped as a longitudinal bar.

(11) The electrical connector of any of configurations (1) through (10), wherein the upper seal portion includes downturned ends each configured to contact the lower seal portion when the actuator is in the closed position.

(12) The electrical connector of any of configurations (1) through (11), wherein the lower seal portion is shaped as a longitudinal bar.

(13) The electrical connector of any of configurations (1) through (12), wherein the housing includes a rear housing portion and a front housing portion that is detachable from the rear housing portion, the contacts are held in the rear housing portion, and the front housing portion includes a lower front portion and an upper front portion that is detachable from the lower front portion, in which the lower front portion includes a lower seal groove configured to receive a lower portion of the resilient member, and the upper front portion includes an upper seal groove configured to receive an upper portion of the resilient member.

(14) The electrical connector of any of configurations (1) through (13), wherein the resilient member is a one-piece elongated ring having a hole configured to receive the mating component.

(15) The electrical connector of any of configurations (1) through (14), wherein the housing includes a top surface having at least one groove configured to accommodate at least one portion of the actuator when the actuator is in the closed position.

(16) The electrical connector of any of configurations (1) through (15), wherein, when the actuator is in the closed position, a surface of the actuator is coplanar with the top surface of the housing.

(17) The electrical connector of any of configurations (1) through (16), wherein the actuator includes a longitudinal arm and first and second side arms extending from first and second ends of the longitudinal arm, the housing includes first and second grooves configured to accommodate that first and second side arms when the actuator is in the closed position.

(18) The electrical connector of any of configurations (1) through (17), wherein each of the first and second side arms include at least one positioning peg, each of the first and second grooves includes at least one lateral groove surface having a recessed guide and a peg hole at an end of the recessed guide, and each of the at least one positioning peg of the first and second side arms is configured to side along a corresponding one of the recessed guides of the first and second grooves and, when the end of the recessed guide is reached, to lock into an assembled position in which the positioning peg is received in a corresponding one of the peg holes.

(19) The electrical connector of any of configurations (1) through (18), wherein the first and second side arms each have a pivot end at which the at least one positioning peg is located, each of the pivot ends includes a flat surface that abuts a surface of the housing when the actuator is in the opened position, to limit pivoting rotation of the actuator relative to the housing, and each of the pivot ends includes an arcuate surface that faces the housing when the actuator pivots to and from the opened and closed positions.

(20) The electrical connector of any of configurations (1) through (19), wherein a height of the housing is about 3 mm or less.

(21) The electrical connector of any of configurations (1) through (20), wherein the height of the housing is about 2.2 mm or less.

(22) The electrical connector of any of configurations (1) through (21), wherein the contacts are spaced apart from each other at a pitch of about 3 mm or less.

(23) The electrical connector of any of configurations (1) through (22), wherein the pitch of the contacts is about 2.5 mm or less.

(24) The electrical connector of any of configurations (1) through (23), further comprising a plurality of positioning pegs extending from a bottom surface of the housing, wherein the positioning pegs are configured to enable the electrical connector to be mounted at a predetermined position on a circuit board.

An electrical connector according to the technology described herein may be embodied in different configurations. Example configurations include combinations of configurations (25) through (37), as follows:

(25) An electrical connector comprising: a housing having a slot configured to receive a mating component; a plurality of contacts held in the housing and configured to be in electrical contact with the mating component when the mating component is in a mated position in the slot; a sealing member having at least a portion supported by the housing; an actuator coupled to the housing and movable from an opened position, in which the mating component may be inserted in the slot, to a closed position, in which a biasing force is applied on the sealing member such that, when the mating component is in the mated position in the slot, the sealing member provides a seal to prevent moisture and debris from entering the slot.

(26) The electrical connector of configuration (25), wherein the sealing member includes a lower seal portion and an upper seal portion, the housing includes a lower seal groove configured to receive the lower seal portion, a longitudinal arm of the actuator includes an upper seal groove configured to receive the upper seal portion, and, when the actuator is in the opened position, the lower seal portion does not directly contact the upper seal portion.

(27) The electrical connector of any of configurations (25) through (26), wherein the lower seal portion includes upturned ends each configured to contact the upper seal portion when the actuator is in the closed position.

(28) The electrical connector of any of configurations (25) through (27), wherein the upper seal portion is shaped as a longitudinal bar.

(29) The electrical connector of any of configurations (25) through (28), wherein the upper seal portion includes downturned ends each configured to contact the lower seal portion when the actuator is in the closed position.

(30) The electrical connector of any of configurations (25) through (29), wherein the lower seal portion is shaped as a longitudinal bar.

(31) The electrical connector of any of configurations (25) through (30), wherein the housing includes a rear housing portion and a front housing portion that is detachable from the rear housing portion, the contacts are held in the rear housing portion, and the front housing portion includes a lower front portion and an upper front portion that is detachable from the lower front portion, in which the lower front portion includes a lower seal groove configured to receive a lower portion of the sealing member, and the upper front portion includes an upper seal groove configured to receive an upper portion of the sealing member.

(32) The electrical connector of any of configurations (25) through (31), wherein the sealing member is a one-piece elongated ring having a hole configured to receive the mating component.

(33) The electrical connector of any of configurations (25) through (32), wherein the actuator includes at least one latching protrusion configured to latch with the housing when the actuator is in the closed position.

(34) The electrical connector of any of configurations (25) through (33), wherein each latching protrusion is configured to produce an audible sound when the actuator is pivoted to the closed position.

(35) The electric connector of any of configurations (25) through (34), wherein the actuator includes at least one blocking protrusion configured to face a blocking surface of the mating component when the mating component is in the mated position and the actuator is in the closed position.

(36) The electrical connector of any of configurations (25) through (35), wherein the housing includes a ledge configured to stop the actuator from pivoting beyond the closed position.

(37) The electrical connector of any of configurations (25) through (36), wherein the actuator includes a longitudinal arm and first and second side arms extending from first and second ends of the longitudinal arm, the first and second side arms each have a pivot end that is pivotably attached to the housing, each of the pivot ends includes a flat surface that abuts a surface of the housing when the actuator is in the opened position, to limit pivoting rotation of the actuator relative to the housing, and each of the pivot ends includes an arcuate surface that faces the housing when the actuator pivots to and from the opened and closed positions.

Methods of assembling an electrical connector that includes a housing, a resilient member, and an actuator according to the technology described herein may include various processes. Example methods include combinations of processes (38) through (42), as follows:

(38) A method of assembling an electrical connector that includes a housing, a resilient member, and an actuator, the method comprising: placing a lower seal portion of the resilient member in a lower seal groove of the housing; placing an upper seal portion of the resilient member in an upper seal groove of the actuator; and attaching the actuator to the housing such that the actuator is movable from an opened position to a closed position in which a biasing force is applied on the resilient member to urge the upper and lower sealing portions toward each other.

(39) The method of process (38), wherein, in the closed position, the resilient member provides a moisture-resistant seal around a surface of a mating component then the mating component is in a mated position in a slot of the housing.

(40) The method of any of processes (38) through (39), wherein, when the actuator is in the opened position, the lower seal portion does not directly contact the upper seal portion.

(41) The method of any of processes (38) through (40), wherein the lower seal portion includes upturned ends each configured to contact the upper seal portion when the actuator is in the closed position.

(42) The method of any of processes (38) through (41), wherein the attaching includes: sliding positioning pegs, which are located on side arms of the actuator, along recessed guides in the housing; and pivotably locking the actuator to the housing by causing the positioning pegs to be received in peg holes in the housing.

Methods of assembling an electrical connector that includes a housing, an actuator, and a resilient member having a hole according to the technology described herein may include various processes. Example methods include combinations of processes (43) through (45), as follows:

(43) A method of assembling an electrical connector that includes a housing, an actuator, and a resilient member having a hole, and the method comprising: assembling a front section of the housing by inserting a first portion of the resilient member in a first groove of a first part of the front section, inserting a second portion of the resilient member in a second groove of a second part of the front section, and joining the first and second parts of the front section together such that the resilient member encircles an inner peripheral surface of a slot of the housing; attaching the front section of the housing to a rear section of the housing; and attaching the actuator to the rear section of the housing such that the actuator is movable from an opened position to a closed position in which a compressive force is applied on the resilient member.

(44) The method of process (43), wherein, in the closed position, the resilient member provides a moisture resistant seal around a surface of a mating component then the mating component is in a mated position in the slot of the housing.

(45) The method of any of processes (43) through (44), wherein the attaching of the actuator includes: sliding positioning pegs, which are located on side arms of the actuator, along recessed guides in the rear section of the housing; and pivotably locking the actuator to the rear section of the housing by causing the positioning pegs to be received in peg holes in the rear section of the housing.

CONCLUSION

It should be understood that various alterations, modifications, and improvements may be made to the structures, configurations, and methods discussed above, and are intended to be within the spirit and scope of the invention disclosed herein. Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. An electrical connector comprising:

a housing having a slot configured to receive a mating component;

a plurality of contacts held in the housing and configured to be in electrical contact with the mating component when the mating component is in a mated position in the slot;

a resilient member having at least a portion supported by the housing; and an actuator pivotably coupled to the housing and configured to have:

an opened position in which the mating component may be inserted in the slot, and a closed position in which a biasing force is applied on the resilient member such that, when the mating component is in the mated position in the slot, the resilient member provides a moisture-resistant seal around a surface of the mating component.

2. The electrical connector of claim 1, wherein the actuator includes at least one latching protrusion configured to latch with the housing when the actuator is in the closed position.

3. The electrical connector of claim 2, wherein each latching protrusion is configured to produce an audible sound when the actuator is pivoted to the closed position.

4. The electric connector of claim 1, wherein the actuator includes at least one blocking protrusion configured to face a blocking surface of the mating component when the mating component is in the mated position and the actuator is in the closed position.

5. The electrical connector of claim 1, wherein the resilient member includes a lower seal portion and an upper seal portion, the housing includes a ledge with a lower seal groove configured to receive the lower seal portion, the actuator includes a longitudinal arm with an upper seal groove configured to receive the upper seal portion, and, when the actuator is in the opened position, the lower seal portion does not directly contact the upper seal portion.

6. The electrical connector of claim 5, wherein the lower seal portion includes upturned ends each configured to contact the upper seal portion when the actuator is in the closed position.

7. The electrical connector of claim 5, wherein the upper seal portion includes downturned ends each configured to contact the lower seal portion when the actuator is in the closed position.

8. The electrical connector of claim 1, wherein the housing includes a rear housing portion and a front housing portion that is detachable from the rear housing portion, the contacts are held in the rear housing portion, and the front housing portion includes a lower front portion and an upper front portion that is detachable from the lower front portion, in which the lower front portion includes a lower seal groove configured to receive a lower portion of the resilient member, and the upper front portion includes an upper seal groove configured to receive an upper portion of the resilient member.

9. The electrical connector of claim 8, wherein the resilient member is a one-piece elongated ring having a hole configured to receive the mating component when the mating component is a flexible flat cable (FFC).

10. The electrical connector of claim 1, wherein the housing includes a top surface having at least one groove configured to accommodate at least one portion of the actuator when the actuator is in the closed position.

11. The electrical connector of claim 1, wherein the actuator includes a longitudinal arm and first and second side arms extending from first and second ends of the longitudinal arm, the housing includes first and second grooves configured to accommodate the first and second side arms when the actuator is in the closed position.

12. The electrical connector of claim 1, wherein a height of the housing is about 3 mm or less.

13. An electrical connector comprising:

a housing having a slot configured to receive a mating component;

a plurality of contacts held in the housing and configured to be in electrical contact with the mating component when the mating component is in a mated position in the slot;

a sealing member having at least a portion supported by the housing; and an actuator coupled to the housing and movable from an opened position, in which the mating component may be inserted in the slot, to a closed position, in which a biasing force is applied on the sealing member such that, when the mating component is in the mated position in the slot, the sealing member provides a seal to prevent moisture and debris from entering the slot.

14. The electrical connector of claim 13, wherein the sealing member includes a lower seal portion and an upper seal portion, the housing includes a lower seal groove configured to receive the lower seal portion, a longitudinal arm of the actuator includes an upper seal groove configured to receive the upper seal portion, and, when the actuator is in the opened position, the lower seal portion does not directly contact the upper seal portion.

15. The electrical connector of claim 14, wherein the lower seal portion includes upturned ends each configured to contact the upper seal portion when the actuator is in the closed position.

16. The electrical connector of claim 14, wherein the upper seal portion includes downturned ends each configured to contact the lower seal portion when the actuator is in the closed position.

17. The electrical connector of claim 13, wherein the housing includes a rear housing portion and a front housing portion that is detachable from the rear housing portion, the contacts are held in the rear housing portion, and the front housing portion includes a lower front portion and an upper front portion that is detachable from the lower front portion, in which the lower front portion includes a lower seal groove configured to receive a lower portion of the sealing member, and the upper front portion includes an upper seal groove configured to receive an upper portion of the sealing member.

18. The electrical connector of claim 17, wherein the sealing member is a one-piece elongated ring having a hole configured to receive the mating component, when the mating component is a flexible flat cable (FFC).

19. The electric connector of claim 13, wherein the actuator includes at least one blocking protrusion configured to face a blocking surface of the mating component when the mating component is in the mated position and the actuator is in the closed position.

20. The electrical connector of claim 13, wherein the actuator includes a longitudinal arm and first and second side arms extending from first and second ends of the longitudinal arm, the first and second side arms each have a pivot end that is pivotably attached to the housing, each of the pivot ends includes a flat surface that abuts a surface of the housing when the actuator is in the opened position, to limit pivoting rotation of the actuator relative to the housing, and each of the pivot ends includes an arcuate surface that faces the housing when the actuator pivots to and from the opened and closed positions.

* * * * *